US011192157B2

(12) United States Patent
Ishii et al.

(10) Patent No.: US 11,192,157 B2
(45) Date of Patent: Dec. 7, 2021

(54) CROSS ANGLE IDENTIFICATION METHOD, CROSS ANGLE IDENTIFICATION DEVICE, AND ROLLING MILL

(71) Applicant: NIPPON STEEL CORPORATION, Tokyo (JP)

(72) Inventors: Atsushi Ishii, Tokyo (JP); Shota Ishitsuka, Tokyo (JP); Yuuto Okabe, Tokyo (JP); Daisuke Nikkuni, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 215 days.

(21) Appl. No.: 16/484,321

(22) PCT Filed: Feb. 28, 2018

(86) PCT No.: PCT/JP2018/007502

§ 371 (c)(1),
(2) Date: Aug. 7, 2019

(87) PCT Pub. No.: WO2018/163930

PCT Pub. Date: Sep. 13, 2018

(65) Prior Publication Data

US 2019/0381548 A1 Dec. 19, 2019

(30) Foreign Application Priority Data

Mar. 7, 2017 (JP) ..... JP2017-043071

(51) Int. Cl.
*B21B 37/58* (2006.01)
*B21B 38/10* (2006.01)
*B21B 31/18* (2006.01)

(52) U.S. Cl.
CPC ..... *B21B 37/58* (2013.01); *B21B 31/185* (2013.01); *B21B 38/10* (2013.01)

(58) Field of Classification Search
CPC ..... B21B 37/38; B21B 37/42; B21B 37/58; B21B 38/08; B21B 2265/12; B21B 2269/02; B21B 2269/04; B21B 29/00
(Continued)

(56) References Cited

U.S. PATENT DOCUMENTS 5,666,837 A 9/1997 Kajiwara et al.
6,012,319 A * 1/2000 Narita ..... B21B 13/023 72/241.2

FOREIGN PATENT DOCUMENTS

CN 202606507 U 12/2012
JP 6-182418 A 7/1994
(Continued)

OTHER PUBLICATIONS

Takebayashi, Translation of JP-2009178754 (Year: 2009).*
(Continued)

*Primary Examiner* — Gregory D Swiatocha
*Assistant Examiner* — Bobby Yeonjin Kim
(74) *Attorney, Agent, or Firm* — Birch, Stewart, Kolasch & Birch, LLP

(57) ABSTRACT

The present invention provides a method for identifying an inter-roll cross angle in a rolling mill of four-high or more including at least a pair of work rolls and a pair of backup rolls by, when rolling is not performed, applying a roll bending force to apply a load between rolls of an upper roll assembly including the work roll on the upper side and between rolls of a lower roll assembly including the work roll on the lower side, in a state where a roll gap between the work rolls is put into an open state, detecting vertical roll loads that act in the vertical direction on the rolling support positions on the working side and the driving side of at least one of the backup roll on the upper side or the backup roll on the lower side, and calculating a load difference between
(Continued)

the vertical roll loads on the working side and the driving side.

3 Claims, 17 Drawing Sheets

(58) Field of Classification Search
USPC ..... 72/10.4, 229
See application file for complete search history.

(56) References Cited

FOREIGN PATENT DOCUMENTS

| | | | | | |
|---|---|---|---|---|---|
| JP | 10-128416 | A | | 5/1998 | |
| JP | 11-179409 | A | | 7/1999 | |
| JP | 2003-290806 | A | | 10/2003 | |
| JP | 3499107 | B2 | | 2/2004 | |
| JP | 4161606 | B2 | | 10/2008 | |
| JP | 2009-178754 | A | | 8/2009 | |
| JP | 2009178754 | A | * | 8/2009 | ..... B21B 37/38 |
| JP | 2012-121050 | A | | 6/2012 | |
| JP | 4962334 | B2 | | 6/2012 | |
| JP | 2014-4599 | A | | 1/2014 | |
| KP | 2003-0053388 | A | | 6/2003 | |
| WO | WO-9411129 | A1 | * | 5/1994 | ..... B21B 37/28 |

OTHER PUBLICATIONS

Korean Office Action dated Nov. 4, 2020 for Applcation No. 10-2019-7027083.
Chinese Office Action and Search Report for corresponding Chinese Application No. 201880016252.X, dated Apr. 10, 2020, with partial English translation.
English translation of the Written Opinion of the International Searching Authority for International Application No. PCT/JP2018/007502, dated May 1, 2018.
1st Office Action for JP 2018-533717 dated Aug. 7, 2018.
2nd Office Action for JP 2018-533717 dated Oct. 23, 2018.
International Search Report for PCT/JP2018/007502 dated May 1, 2018.
Written Opinion of the International Searching Authority for PCT/JP2018/007502 (PCT/ISA/237) dated May 1, 2018.

* cited by examiner

CROSS ANGLE IDENTIFICATION METHOD, CROSS ANGLE IDENTIFICATION DEVICE, AND ROLLING MILL

TECHNICAL FIELD

The present invention relates to a cross angle identification method for identifying an inter-roll cross angle in a rolling mill that rolls a flat-rolled metal material, a cross angle identification device, and a rolling mill including this.

BACKGROUND ART

An example of a phenomenon that causes troubles of threading in a hot rolling process is zigzagging (lateral traveling) of a steel sheet. One of causes of a steel sheet zigzagging is a thrust force generated at an inter-roll minute cross (also referred to as roll skew) of a rolling mill, but a thrust force is difficult to measure directly. Hence, it conventionally has been proposed that zigzagging of a steel sheet could be controlled on the basis of measuring a thrust counterforce detected as a counterforce of the sum of thrust forces generated between rolls (hereinafter, also referred to as "inter-roll thrust force") or measuring an inter-roll cross angle that causes a thrust force to be generated.

For example, Patent Literature 1 discloses a flat rolling method that measures a thrust counterforce in the axial direction of rolls and a load in the vertical direction, obtains either one or both of a reduction position zero point and deformation characteristics of a rolling mill, and sets a reduction position in rolling execution to control rolling. In addition, Patent Literature 2 discloses a zigzagging control method that calculates a thrust force generated on a roll on the basis of an inter-roll minute cross angle (roll skew angle) measured using a distance sensor provided inside a rolling mill, calculates a differential load component due to zigzagging from a load measurement value in the vertical direction on the basis of the thrust force, and controls reduction leveling. Furthermore, Patent Literature 3 discloses a rolling mill control method that, in detecting a load difference between the driving side and the operator side, and independently operating reduction positions on the driving side and the operator side on the basis of the detected load difference to control zigzagging of a rolled material, estimates a differential load due to thrust during rolling, thereby separating a differential load during rolling into that caused by zigzagging of the rolled material and that caused by thrust, and operates reduction positions on the driving side and the operator side on the basis of these separated differential loads.

CITATION LIST

Patent Literature

Patent Literature 1: JP 3499107B
Patent Literature 2: JP 2014-4599A
Patent Literature 3: JP 4962334B

SUMMARY OF INVENTION

Technical Problem

However, the technology described in Patent Literature 1 above requires measurement of a thrust counterforce of a roll other than a backup roll; hence, the flat rolling method in Patent Literature 1 cannot be performed without a device that measures a thrust counterforce. In addition, the technology described in Patent Literature 2 above obtains a roll skew angle from a horizontal direction distance of a roll measured by a distance sensor of an eddy current type or the like. However, decentering of a roll body length portion or machining precision such as cylindricity causes the roll to vibrate in the horizontal direction, and impact at the time of gripping when rolling is started etc. causes a chock position in the horizontal direction to fluctuate; thus, it is difficult to accurately measure a horizontal displacement of the roll that causes a thrust force to be generated. In addition, a frictional coefficient of a roll changes from moment to moment, because roughness of a roll changes over time as the number of coils increases. Therefore, a thrust force cannot be accurately calculated from only roll skew angle measurement without identification of a frictional coefficient.

Furthermore, prior to rolling, the technology described in Patent Literature 3 above applies a bending force while driving rolls in a state where upper and lower rolls are not in contact with each other, and estimates a differential load caused by thrust from a thrust coefficient or an amount of skew obtained from a load difference between the driving side and the working side generated at that time. In Patent Literature 3, a thrust coefficient or an amount of skew is identified from only a measurement value in one rotation state of the upper and lower rolls. Therefore, in the case where the influence of a shift of a zero point of a load detection device or frictional resistance between a housing and a roll chock is different between the left and right, a left-right asymmetric error may occur in a measurement value on the driving side and a measurement value on the working side. Particularly in the case where a load level is low as in application of a bending force, this error can be a fatal error in identification of a thrust coefficient or an amount of skew. In addition, in Patent Literature 3, a thrust coefficient or an amount of skew cannot be identified unless an inter-roll frictional coefficient is given. Furthermore, in Patent Literature 3, a thrust counterforce of a backup roll is assumed to act on a roll axial center position, and a change in a position of a point of a thrust counterforce is not considered. Usually, a chock of a backup roll is supported by a screw down device or the like; hence, the position of the point of the thrust counterforce is not necessarily located at the roll axial center. Therefore, an error occurs in an inter-roll thrust force obtained from a load difference between a vertical roll load on the driving side and a vertical roll load on the working side, and an error occurs also in a thrust coefficient or an amount of skew calculated on the basis of the inter-roll thrust force.

Hence, the present invention has been made in view of the above problems, and an object of the present invention is to provide a novel and improved cross angle identification method, cross angle identification device, and rolling mill capable of precisely identifying an inter-roll cross angle.

Solution to Problem

According to an aspect of the present disclosure in order to achieve the above object, there is provided a cross angle identification method for identifying an inter-roll cross angle of a rolling mill, the rolling mill being a rolling mill of four-high or more that includes a plurality of rolls including at least a pair of work rolls and a pair of backup rolls, the cross angle identification method including: a roll bending force application step of, when rolling is not performed, applying a roll bending force to apply a load between rolls of an upper roll assembly including the work roll on the upper side and between rolls of a lower roll assembly including the work roll on the lower side, in a state where a roll gap between the work rolls is put into an open state; a load detection step of detecting vertical roll loads that act in the vertical direction on the rolling support positions on the working side and the driving side of at least one of the backup roll on the upper side or the backup roll on the lower side; a load difference calculation step of calculating a load difference between the vertical roll load on the working side and the vertical roll load on the driving side that are detected; and an identification step of identifying the inter-roll cross angle on the basis of the load difference. The load detection step performs one of normal rotation and reverse rotation of the rolls or rotation and stop of the rolls, and detects the vertical roll loads on the working side and the driving side in each rotation state of the rolls.

The load detection step may set at least two levels or more of roll bending forces applied in an open state of the roll gap, and detect vertical roll loads at each level, and the identification step may further identify an inter-roll frictional coefficient, or a position of a point of a thrust counterforce acting on the backup roll.

In addition, the load detection step may set at least three levels or more of roll bending forces applied in an open state of the roll gap, and detect vertical roll loads at each level, and the identification step may further identify an inter-roll frictional coefficient, and a position of a point of a thrust counterforce acting on the backup roll.

According to another aspect of the present disclosure in order to achieve the above object, there is provided a cross angle identification device that identifies an inter-roll cross angle of a rolling mill, the rolling mill being a rolling mill of four-high or more that includes a plurality of rolls including at least a pair of work rolls and a pair of backup rolls, the cross angle identification device including: a differential load calculation unit that calculates, on the basis of vertical roll loads that act in the vertical direction on the rolling support positions on the working side and the driving side of at least one of the backup roll on the upper side or the backup roll on the lower side, a load difference between the vertical roll load on the working side and the vertical roll load on the driving side; and an identification processing unit that identifies the inter-roll cross angle on the basis of the load difference. The vertical roll load on the working side and the vertical roll load on the driving side input to the differential load calculation unit are values detected in each rotation state of the rolls that are obtained by performing one of normal rotation and reverse rotation of the rolls or rotation and stop of the rolls in a state where, when rolling is not performed, a roll gap between the work rolls is put into an open state, and a roll bending force is applied to apply a load between rolls of an upper roll assembly including the work roll on the upper side and between rolls of a lower roll assembly including the work roll on the lower side.

The vertical roll loads may be detected by setting at least two levels or more of roll bending forces applied in an open state of the roll gap, and an inter-roll frictional coefficient, or a position of a point of a thrust counterforce acting on the backup roll may be further identified on the basis of the load difference between the vertical roll loads detected at each level.

In addition, the vertical roll loads may be detected by setting at least three levels or more of roll bending forces applied in an open state of the roll gap, and an inter-roll frictional coefficient, and a position of a point of a thrust counterforce acting on the backup roll may be further identified on the basis of the load difference between the vertical roll loads detected at each level.

According to another aspect of the present disclosure in order to achieve the above object, there is provided a rolling mill of four-high or more that includes a plurality of rolls including at least a pair of work rolls and a pair of backup rolls, the rolling mill including: a loading device that applies a roll bending force to apply a load between rolls of an upper roll assembly including the work roll on the upper side and between rolls of a lower roll assembly including the work roll on the lower side, in a state where a roll gap between the work rolls is put into an open state; and the above cross angle identification device.

Advantageous Effects of Invention

According to the present invention as described above, precisely identifying an inter-roll cross angle makes it possible to, for example, reduce an inter-roll thrust force, and suppress occurrence of zigzagging and camber of a material to be rolled.

DESCRIPTION OF EMBODIMENTS

Figure 1:
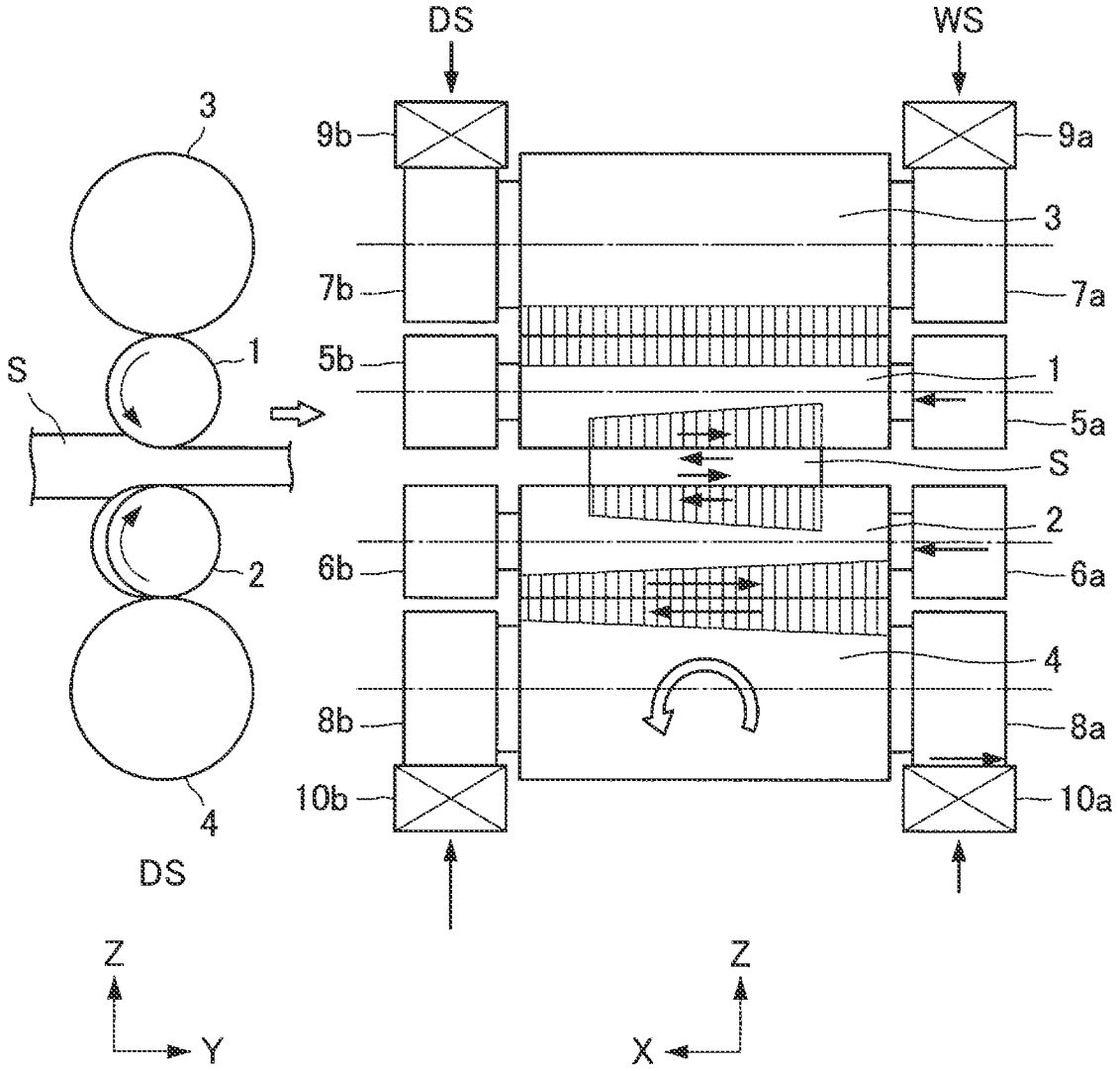
FIG. 1 shows a schematic side view and a schematic front view of a rolling mill for describing a thrust force and a thrust counterforce generated between rolls of the rolling mill when rolling is performed.

Hereinafter, (a) preferred embodiment(s) of the present invention will be described in detail with reference to the appended drawings. Note that, in this specification and the appended drawings, structural elements that have substantially the same function and structure are denoted with the same reference numerals, and repeated explanation of these structural elements is omitted.

1. Purpose

In detailing a cross angle identification device according to an embodiment of the present invention, first, the purpose of identifying an inter-roll cross angle is described on the basis of FIG. 1 to FIG. 7.

In rolling of a material to be rolled using a rolling mill, the present invention aims to identify an inter-roll cross angle that occurs between rolls, and adjust the inter-roll cross angle on the basis of an identification result, thereby eliminating a thrust force that occurs between rolls, and stably producing a product without zigzagging and camber or with very minor zigzagging and camber. The present invention targets a rolling mill of four-high or more at least including a pair of work rolls and a pair of backup rolls that support the respective work rolls. In the case of a four-high rolling mill, an inter-roll cross angle is identified to prevent an inter-roll thrust force from occurring between a work roll and a backup roll that are in contact with each other. In the case of a six-high rolling mill, an inter-roll cross angle is identified to prevent an inter-roll thrust force from occurring between a work roll and an intermediate roll that are in contact with each other, and between an intermediate roll and a backup roll.

An inter-roll thrust force causes an excess moment to be generated on a roll, and causes asymmetric roll deformation to put rolling into an unstable state, for example, causes zigzagging or camber. This inter-roll thrust force is generated by, for example, in the case of a four-high rolling mill, a shift occurring in the axial direction of rolls between a work roll and a backup roll. Hence, in the present invention, an inter-roll thrust force is prevented from being generated by identifying an inter-roll cross angle that causes an inter-roll thrust force to be generated, and adjusting a roll position to make the inter-roll cross angle zero.

Here, an inter-roll cross angle is difficult to measure directly. Therefore, in the present invention, a load detection device is used to detect a load on a roll in the vertical direction (hereinafter, also referred to as "vertical roll load"), and the inter-roll cross angle is identified from a change in the vertical roll load. When the inter-roll cross angle is not zero, there is generated a difference between a vertical roll load on the working side and a vertical roll load on the driving side of the roll. Consequently, the inter-roll cross angle can be identified from the difference between the vertical roll loads. At this time, the inter-roll cross angle is identified on the basis of vertical roll loads detected with a roll gap between work rolls put into an open state. Reasons for this are described below.

(Difference Between Vertical Roll Loads when Rolling is Performed)

First, description is given on a thrust force generated when rolling is performed and a difference between vertical roll loads; a difference between vertical roll loads caused by an inter-roll thrust force during rolling is generated only on the side where an inter-roll cross angle is caused, of an upper roll assembly and a lower roll assembly, and is hardly generated on the side where an inter-roll cross angle is not caused.

FIG. 1 shows a schematic side view and a schematic front view of a rolling mill for describing a thrust force and a thrust counterforce generated between rolls of the rolling mill when a material to be rolled S is rolled. Note that as illustrated in FIG. 1, the working side in the axial direction of rolls is expressed as Work Side (WS), and the driving side is expressed as Drive Side (DS) in the following description.

The rolling mill illustrated in FIG. 1 includes a pair of work rolls including an upper work roll 1 and a lower work roll 2, and a pair of backup rolls including an upper backup roll 3 that supports the upper work roll 1 and a lower backup roll 4 that supports the lower work roll 2 in the vertical direction (Z direction). A plurality of rolls constituting a rolling mill are also referred to as roll assembly in the present invention. In the case of the four-high rolling mill illustrated in FIG. 1, a roll assembly includes four rolls of the upper work roll 1, the lower work roll 2, the upper backup roll 3, and the lower backup roll 4. The rolling mill threads the material to be rolled S between work rolls and performs rolling, thereby making the material to be rolled S have a predetermined thickness. The rolling mill is provided with upper load detection devices 9*a* and 9*b* that detect vertical roll loads related to the upper roll assembly including the upper work roll 1 and the upper backup roll 3 disposed on the upper surface side of the material to be rolled S (that is, being the roll assembly on the upper side including the work roll on the upper side of the roll assembly) in the vertical direction (Z direction). Similarly, the rolling mill is provided with lower load detection devices 10*a* and 10*b* that detect vertical roll loads related to the lower roll assembly including the lower work roll 2 and the lower backup roll 4 disposed on the lower surface side of the material to be rolled S (that is, being the roll assembly on the lower side including the work roll on the lower side of the roll assembly). The upper load detection device 9*a* and the lower load detection device 10*a* detect vertical roll loads on the working side, and the upper load detection device 9*b* and the lower load detection device 10*b* detect vertical roll loads on the driving side.

The upper work roll 1, the lower work roll 2, the upper backup roll 3, and the lower backup roll 4 are disposed to be orthogonal to a conveyance direction of the material to be rolled S, with axial direction of rolls made parallel. However, when a roll slightly rotates around an axis (Z axis) parallel to the vertical direction, and a shift in the axial direction of rolls occurs in the upper work roll 1 and the upper backup roll 3, or the lower work roll 2 and the lower backup roll 4, a thrust force that acts in the axial direction of rolls is generated between the work roll and the backup roll. For example, as illustrated in FIG. 1, assume that a shift in the axial direction of rolls occurs between the lower work roll 2 and the lower backup roll 4, and an inter-roll cross angle is generated. At this time, a thrust force is generated between the lower work roll 2 and the lower backup roll 4, and as a result, a moment is generated on the lower backup roll 4. Load distribution between the lower work roll 2 and the lower backup roll 4 is changed by the moment, and is balanced by receiving a counterforce from the housing (not illustrated) side. As a result, a load applied to the lower load detection device 10*b* on the driving side becomes larger than a load applied to the lower load detection device 10*a* on the working side, and a differential load occurs.

On the other hand, on reception of a thrust force of the lower roll assembly, a thrust force (hereinafter, also referred to as "roll-material thrust force") acts also between the lower work roll 2 and the material to be rolled S. However, this roll-material thrust force is caused by a minute roll cross, and this roll-material thrust force is relaxed by presence of a forward slip region and a backward slip region in a roll bite, unlike in the case of actively setting a cross angle between a roll and a material as in a cross mill, for example. Consequently, an inter-roll thrust force generated by an inter-roll cross angle of the lower roll assembly hardly influences vertical roll loads of the upper roll assembly detected by the upper load detection devices 9*a* and 9*b*. Thus, a difference between vertical roll loads caused by an inter-roll thrust force during rolling is generated only on the side where an inter-roll cross angle is caused, of the upper roll assembly and the lower roll assembly, and is hardly generated on the side where an inter-roll cross angle is not caused.

(Difference Between Vertical Roll Loads in Kiss Roll State)

Next, description is given on a thrust force generated in a kiss roll state in which a pair of work rolls are brought into contact with each other, and a difference between vertical roll loads. In a kiss roll state, unlike when rolling is performed, an inter-roll thrust force generated on the side where an inter-roll cross angle is caused, of the upper roll assembly and the lower roll assembly, is transferred to the side where an inter-roll cross angle is not caused, via between the upper and lower work rolls.

Figure 2:
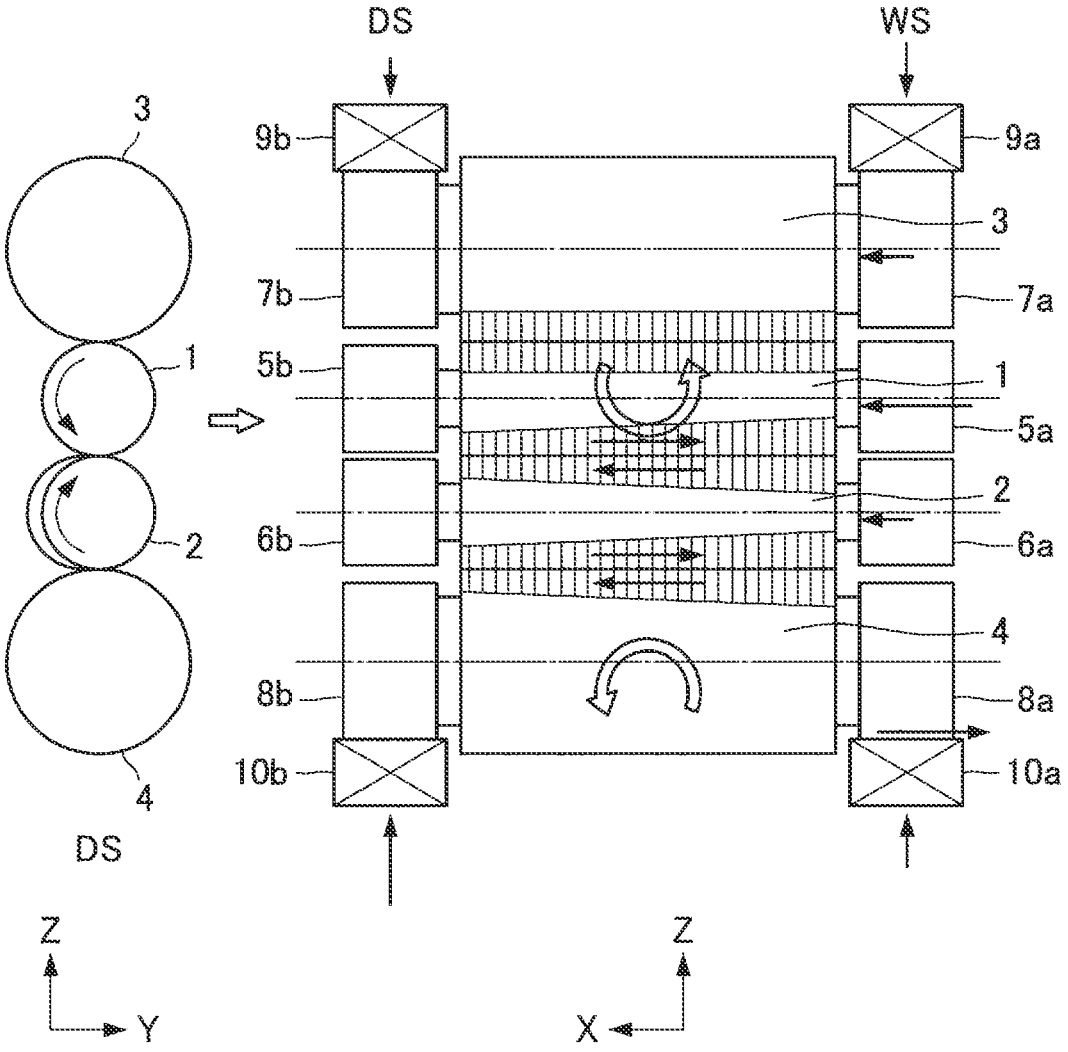
FIG. 2 shows a schematic side view and a schematic front view of a rolling mill for describing a thrust force and a thrust counterforce generated between rolls in the rolling mill in a kiss roll state.

FIG. 2 shows a schematic side view and a schematic front view of a rolling mill for describing a thrust force and a thrust counterforce generated between rolls in the rolling mill in a kiss roll state. For example, as illustrated in FIG. 2, assume that an inter-roll cross angle is generated between the lower work roll 2 and the lower backup roll 4. At this time, a thrust force is generated between the lower work roll 2 and the lower backup roll 4, and as a result, a moment is generated on the lower backup roll 4. The moment causes a load applied to the lower load detection device 10*b* on the driving side to be larger than a load applied to the lower load detection device 10*a* on the working side, and a differential load occurs. On the other hand, the lower work roll 2 and the upper work roll 1 are in contact with each other, and an inter-roll thrust force generated in the lower roll assembly, which is caused by contact between elastic bodies, acts also between the lower work roll 2 and the upper work roll 1, and causes a thrust force between the upper and lower work rolls to be generated. Thus, a moment is generated also on the upper work roll 1, the moment causes a load applied to the upper load detection device 9*a* on the working side to be larger than a load applied to the upper load detection device 9*b* on the driving side, and a differential load occurs.

In this manner, in a kiss roll state, an inter-roll thrust force generated on the side where an inter-roll cross angle is caused is transferred to the side where an inter-roll cross angle is not caused, via between upper and lower work rolls, which is different from a behavior during rolling. Therefore, in a kiss roll state, it is difficult to quantitatively specify an inter-roll cross angle caused between rolls from a detection result of load detection devices.

(Difference Between Vertical Roll Loads in Roll Gap Open State)

As described above, during rolling and in a kiss roll state, it is difficult to identify an inter-roll cross angle from a change in vertical roll load. Hence, to study a method different from these, the inventors made empirical studies using a small rolling mill, and reached the following new findings. That is, in the present invention, the upper roll assembly and the lower roll assembly are identified independently, in order to prevent an inter-roll thrust force on the side where an inter-roll cross angle is caused from influencing a vertical roll load detected on the other side as in the above-described kiss roll state. Therefore, the upper work roll 1 and the lower work roll 2 are separated to put a roll gap into an open state, and an inter-roll cross angle is detected. Thus, for example, even in the case where there is an inter-roll cross angle in the upper roll assembly, so that an inter-roll thrust force is generated and a moment is generated, the inter-roll thrust force generated in the upper roll assembly is not transferred to the lower roll assembly, because the upper work roll 1 and the lower work roll 2 are not in contact with each other. Consequently, a vertical roll load detected by the lower load detection device is a value from which the influence of the inter-roll thrust force of the upper roll assembly is excluded.

Figure 3A:
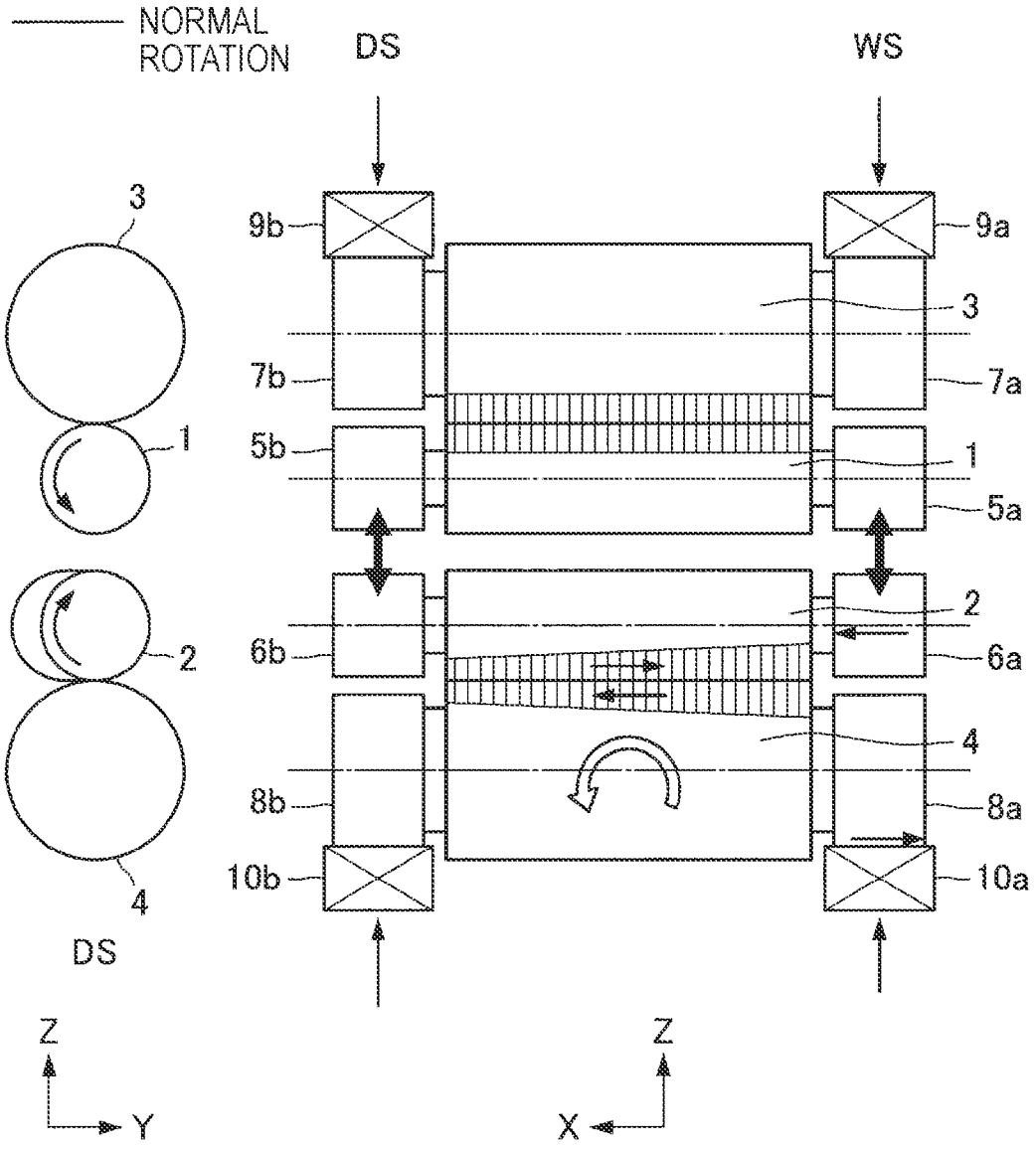
FIG. 3A is a schematic side view and a schematic front view illustrating an example of a driving state of a state of the rolling mill at the time of inter-roll cross angle identification, and illustrates a state where rolls are normally rotated.
Figure 3B:
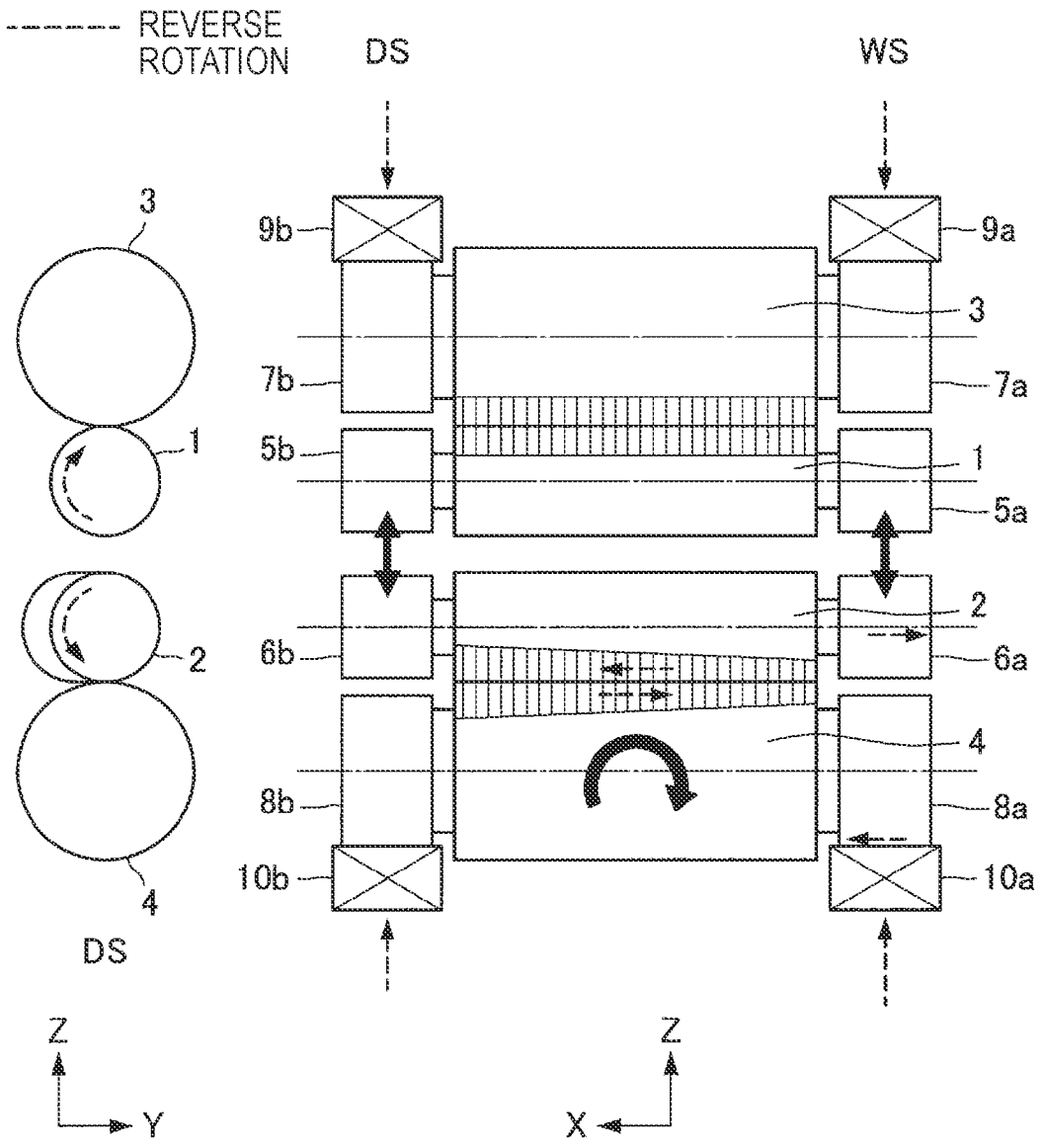
FIG. 3B is a schematic side view and a schematic front view illustrating an example of a driving state of a state of the rolling mill at the time of inter-roll cross angle identification, and illustrates a state where rolls are reversely rotated.
Figure 4:
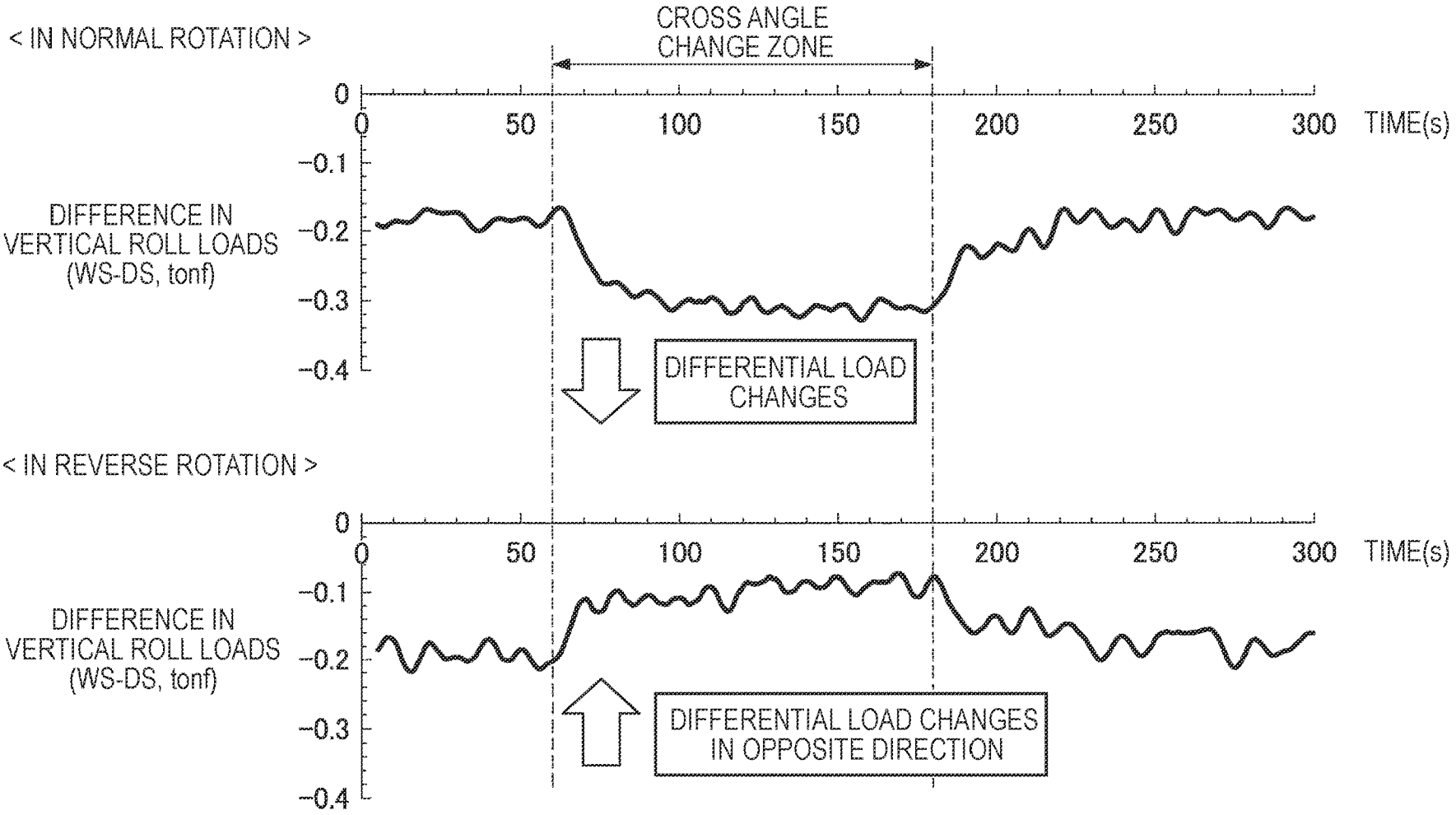
FIG. 4 is an explanatory diagram illustrating a difference in acquired vertical roll load between the case where a roll on the lower side is normally rotated and the case where the roll is reversely rotated in the rolling mill in the state of FIG. 3A and FIG. 3B.
Figure 5:
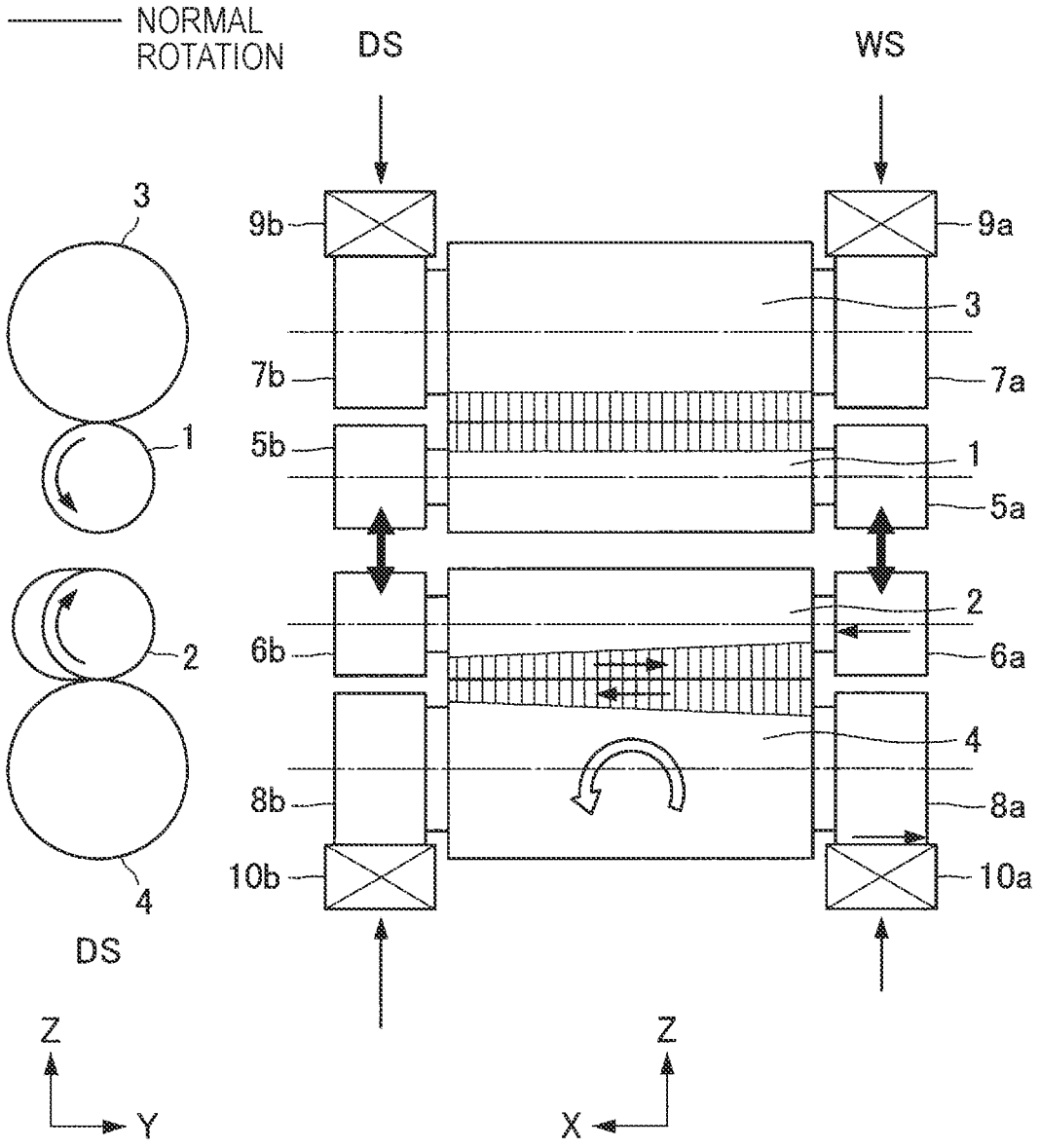
FIG. 5 is a schematic side view and a schematic front view illustrating another example of a driving state of a state of the rolling mill at the time of inter-roll cross angle identification.
Figure 6:
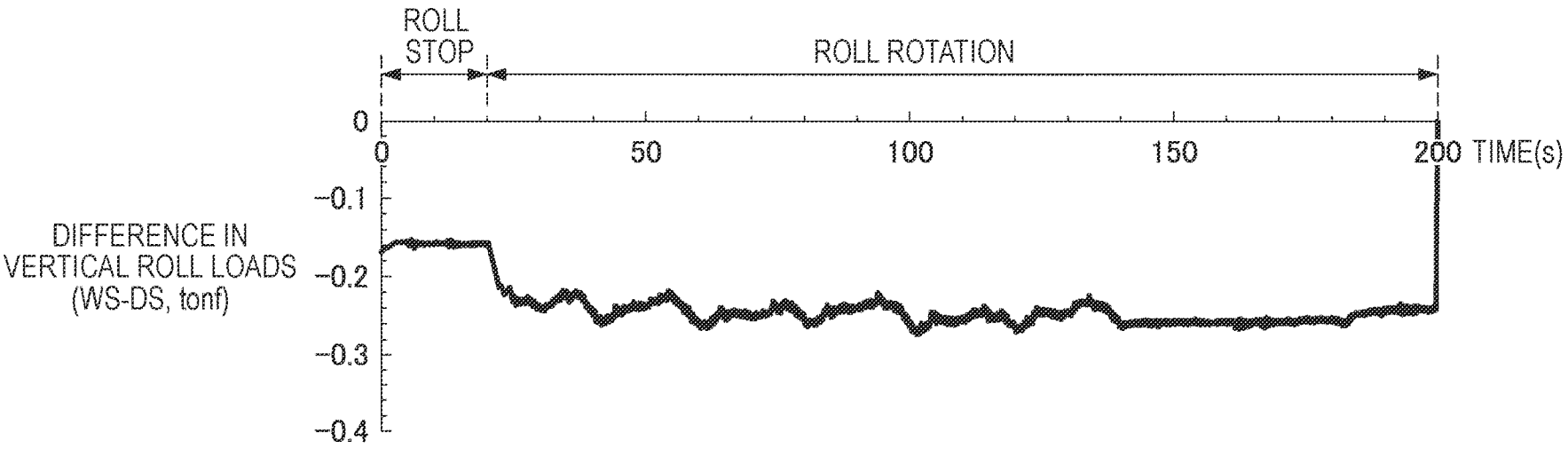
FIG. 6 is an explanatory diagram illustrating a difference in acquired vertical roll loads between the case where a roll on the lower side is stopped and the case where the roll is rotated in the rolling mill in the state of FIG. 5.

FIG. 3A to FIG. 6 illustrate specific examples of an inter-roll cross angle identification method according to the present invention. FIG. 3A is a schematic side view and a schematic front view illustrating a driving state of a state of the rolling mill at the time of inter-roll cross angle identification, showing a specific example of the present invention, and illustrates a state where rolls are normally rotated. FIG. 3B is a schematic side view and a schematic front view illustrating an example of a driving state of a state of the rolling mill at the time of inter-roll cross angle identification, and illustrates a state where rolls are reversely rotated. FIG. 4 is an explanatory diagram illustrating a difference in acquired vertical roll load between the case where a roll on the lower side is normally rotated and the case where the roll is reversely rotated in the rolling mill in the state of FIG. 3A and FIG. 3B. FIG. 5 is a schematic side view and a schematic front view illustrating a driving state of a state of the rolling mill at the time of inter-roll cross angle identification, showing another specific example of the present invention. FIG. 6 is an explanatory diagram illustrating a difference in acquired vertical roll load between the case where a roll on the lower side is stopped and the case where the roll is rotated in the rolling mill in the state of FIG. 5.

(a) Inter-Roll Cross Angle Identification by Roll Normal Rotation/Reverse Rotation An example of the inter-roll cross angle identification method according to the present invention is a method that puts a roll gap between work rolls into an open state, detects vertical roll loads in the case where rolls are normally rotated and the case where rolls are reversely rotated, and identifies an inter-roll cross angle on the basis of the differential load. If an inter-roll cross angle is zero in the target work roll and backup roll, a difference between a vertical roll load detected on the driving side and a vertical roll load detected on the working side is zero. On the other hand, in the case where an inter-roll cross angle is not zero, a moment is generated on a roll, and a difference occurs in vertical roll loads detected on the driving side and the working side. In addition, directions of a moment generated on a roll are opposite during normal rotation and reverse rotation; hence, magnitudes of vertical roll loads detected on the driving side and the working side are also opposite. Hence, an inter-roll cross angle is identified on the basis of differential loads during normal rotation and reverse rotation.

For example, as illustrated in FIG. 3A and FIG. 3B, in a rolling mill including a pair of work rolls 1 and 2 and a pair of backup rolls 3 and 4 that support them, the upper work roll 1 and the lower work roll 2 are separated to put a roll gap between the work rolls 1 and 2 into an open state. Note that the working side of the upper work roll 1 is supported by an upper work roll chock 5*a*, and the driving side is supported by an upper work roll chock 5*b*. The working side of the lower work roll 2 is supported by a lower work roll chock 6*a*, and the driving side is supported by a lower work roll chock 6*b*. In addition, the working side of the upper backup roll 3 is supported by an upper backup roll chock 7*a*, and the driving side is supported by an upper backup roll chock 7*b*. The working side of the lower backup roll 4 is supported by a lower backup roll chock 8*a*, and the driving side is supported by a lower backup roll chock 8*b*. To the upper work roll chocks 5*a* and 5*b* and the lower work roll chocks 6*a* and 6*b*, an increase bending force is applied by increase bending devices (not illustrated) in a state where the work rolls 1 and 2 are separated from each other.

As illustrated in FIG. 3A and FIG. 3B, when the rolls are rotated in a state where an inter-roll cross angle is caused between the lower work roll 2 and the lower backup roll 4, a thrust force is generated between the lower work roll 2 and the lower backup roll 4, and a moment is generated on the lower backup roll 4. Here, in the present example, vertical roll loads are detected in the case where the rolls are normally rotated (FIG. 3A) and the case where the rolls are reversely rotated (FIG. 3B). For example, for each of during normal rotation and reverse rotation, FIG. 4 illustrates a vertical roll load detection result when the lower work roll is rotated around an axis (Z axis) parallel to the vertical direction to change an inter-roll cross angle only in a predetermined cross angle change zone. FIG. 4 is a measurement result obtained by detecting a change in difference between vertical roll loads during normal rotation and reverse rotation, when an inter-roll cross angle of the lower work roll was changed 0.1° to face the exit side on the driving side in a small rolling mill with a work roll diameter of 80 mm. The increase bending force applied to each work roll chock was set to 0.5 tonf/chock.

According to the detection result, a difference between a vertical roll load on the driving side and a vertical roll load on the working side acquired during normal rotation becomes larger in a negative direction as compared with before changing the inter-roll cross angle. On the other hand, a difference between a vertical roll load on the driving side and a vertical roll load on the working side acquired during reverse rotation becomes larger in a positive direction as compared with before changing the inter-roll cross angle. Thus, a differential load appears in opposite ways during normal rotation and reverse rotation.

In the present invention, on the basis of differential loads during normal rotation and reverse rotation, an inter-roll cross angle caused when the differential load is generated is identified. Then, an adjustment is made to make the identified inter-roll cross angle zero, which makes it possible to eliminate occurrence of an inter-roll thrust force, and stably produce a product without zigzagging and camber or with very minor zigzagging and camber. Note that in the example illustrated in FIG. 4, a differential load has appeared before the change of the inter-roll cross angle. This is presumably because the influence of a shift of a zero point of a load detection device etc., housing-chock frictional resistance, or the like causes values detected by the load detection devices to include a left-right asymmetric error. In regard to the housing-chock frictional resistance, frictional resistance acts oppositely to an open-close direction of a reduction position to influence a detection result of the load detection devices, and can result in an error in difference between vertical roll loads in the case where there is a left-right difference in frictional coefficient. Such an error can be fatal in identification of an inter-roll cross angle, particularly when a load level is low as in application of a bending force. The method according to the present invention can exclude the influence of this disturbance by identifying an inter-roll cross angle by comparison between during normal rotation and reverse rotation, and moreover, can expect an improvement in identification precision because an amount of change in differential load is twice as large.

(b) Inter-Roll Cross Angle Identification by Roll Rotation Stop and Roll Rotation Another example of the inter-roll cross angle identification method according to the present invention is a method that puts a roll gap between work rolls into an open state, detects vertical roll loads in the case where rolls are stopped and the case where rolls are rotated, and identifies an inter-roll cross angle on the basis of the differential load. In the above-described example, a rolling mill needs to be configured to be able to normally rotate and reversely rotate rolls, but the method shown in the present example can be applied also to the case where a rolling mill is able to rotate rolls only in one direction.

In the case where rolls are not rotated, that is, the case where rolls are at a stop, a driving force due to a speed component in the axial direction of rolls is not caused between rolls: hence, an inter-roll thrust force is not generated. Consequently, an inter-roll cross angle caused by an inter-roll thrust force can be identified by comparing a difference between vertical roll loads detected in a state where the rolls are stopped, and a difference between vertical roll loads detected with the rolls being rotated.

For example, as illustrated in FIG. 5, in a rolling mill having a configuration similar to that in FIG. 3A and FIG. 3B, the upper work roll 1 and the lower work roll 2 are separated to put a roll gap between the work rolls 1 and 2 into an open state. To the upper work roll chocks 5*a* and 5*b* and the lower work roll chocks 6*a* and 6*b*, an increase bending force is applied by increase bending devices (not illustrated) in a state where the work rolls 1 and 2 are separated from each other.

Assuming that an inter-roll cross angle is generated between the lower work roll 2 and the lower backup roll 4, when the lower work roll 2 and the lower backup roll 4 are rotated, a thrust force is generated between the lower work roll 2 and the lower backup roll 4 and a moment is generated on the lower backup roll 4, as illustrated in FIG. 5. The moment causes a load applied to the lower load detection device 10*b* on the driving side to be larger than a load applied to the lower load detection device 10*a* on the working side, and a differential load occurs. On the other hand, in a state where the rolls are stopped, relative slip in the axial direction of rolls does not occur between the lower work roll 2 and the lower backup roll 4; thus, an inter-roll thrust force is not generated. Consequently, in the lower load detection devices 10*a* and 10*b*, vertical roll loads not influenced by an inter-roll thrust force are detected.

FIG. 6 illustrates a change in difference between vertical roll loads detected on the driving side and the working side, between when rolls are at a stop and when rolls are rotated. In the present example, a predetermined inter-roll cross angle was provided between the lower work roll 2 and the lower backup roll 4, vertical roll loads in a state where the rolls were stopped were detected, and then the rolls were rotated and vertical roll loads were detected. FIG. 6 is a measurement result obtained by detecting a change in difference between vertical roll loads during normal rotation and reverse rotation, when an inter-roll cross angle of the lower work roll was changed 0.1° to face the exit side on the driving side in a small rolling mill with a work roll diameter of 80 mm. The increase bending force applied to each work roll chock was set to 0.5 tonf/chock. As illustrated in FIG. 6, a differential load when the rolls are rotated is larger than a differential load when the rolls are at a stop in the negative direction. Thus, the differential load is different between when the rolls are at a stop and when the rolls are rotated.

In the present invention, an inter-roll cross angle is identified on the basis of a differential load between when the rolls are at a stop and when the rolls are rotated. Then, an adjustment is made to make the identified inter-roll cross angle zero, which makes it possible to eliminate occurrence of an inter-roll thrust force, and stably produce a product without zigzagging and camber or with very minor zigzagging and camber. Note that in the example illustrated in FIG. 6, a differential load has appeared when the rolls are at a stop. This is presumably because, as in FIG. 4, the influence of a shift of a zero point of a load detection device etc., housing-chock frictional resistance, or the like causes values detected by the load detection devices to include a left-right asymmetric error. Such an error can be fatal in identification of an inter-roll cross angle, particularly when a load level is low as in application of a bending force. The method according to the present invention can exclude the influence of this disturbance by identifying an inter-roll cross angle by comparison between when the rolls are at a stop and when the rolls are rotated.

Note that in either case of the above (a) and (b), vertical roll loads are detected with a roll gap put into an open state between the work rolls 1 and 2; thus, respective inter-roll cross angles of the upper roll assembly and the lower roll assembly can be identified independently. Identification processing may be executed sequentially for the upper roll assembly and the lower roll assembly, or may be executed concurrently for the upper roll assembly and the lower roll assembly.

As described above, according to the present invention, a roll gap between work rolls is put into an open state, and an inter-roll cross angle between a work roll and a backup roll is detected. Thus, even in the case where there is an inter-roll cross angle on one side, so that a thrust force is generated between the work roll and the backup roll and a moment is generated, the inter-roll thrust force is not transferred to the other side, because the upper work roll and the lower work roll are not in contact with each other. Thus, an inter-roll cross angle can be identified more accurately by calculating a differential load on the basis of vertical roll loads from which the influence of an inter-roll thrust force caused on one side is excluded, and identifying the inter-roll cross angle. Then, an adjustment is made to make the identified inter-roll cross angle zero, which makes it possible to eliminate occurrence of an inter-roll thrust force due to an inter-roll cross angle when rolling is performed, and stably produce a product without zigzagging and camber or with very minor zigzagging and camber. Hereinafter, embodiments of the present invention related to cases of the above (a) and (b) will be described.

2. First Embodiment

Figure 7:
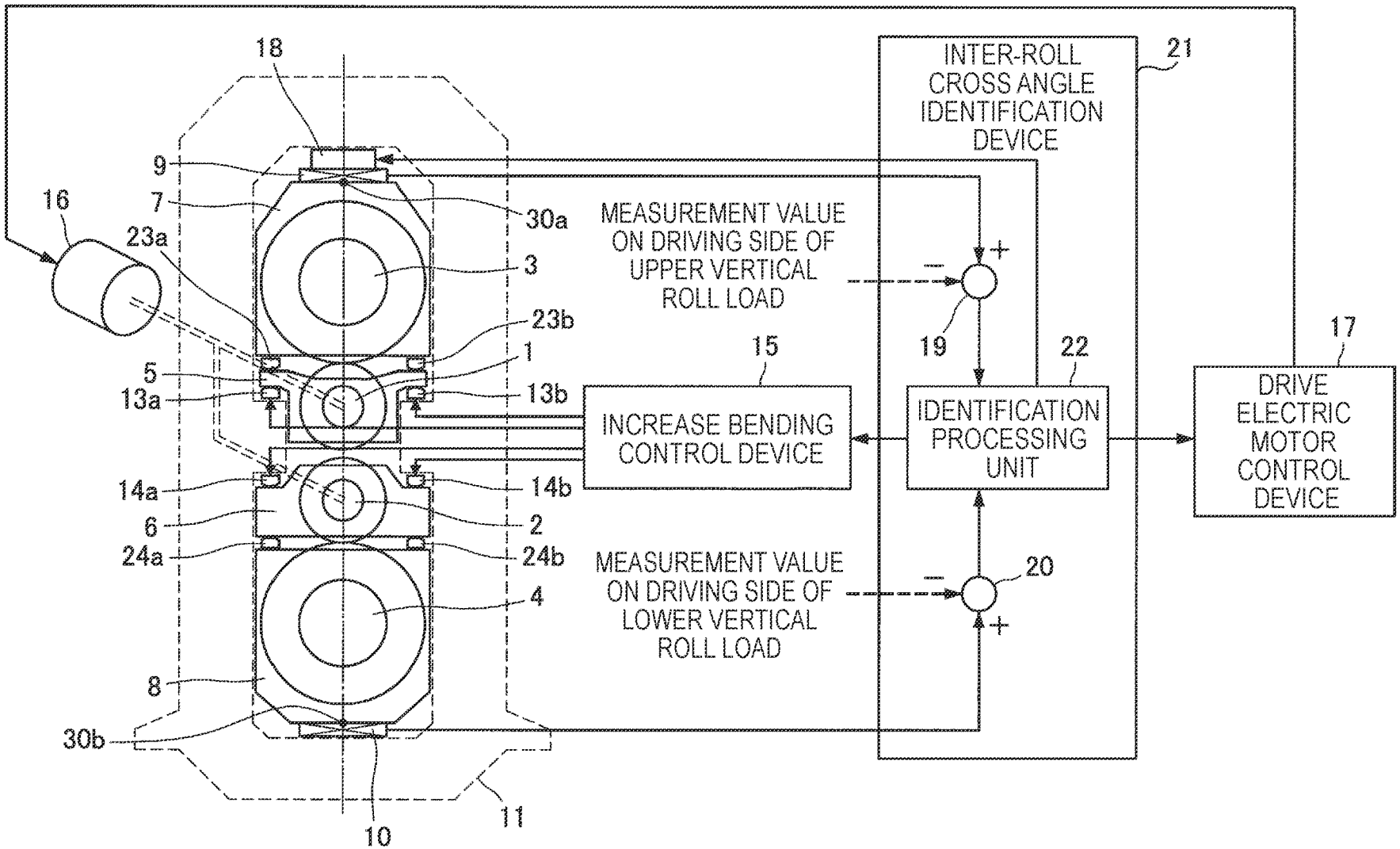
FIG. 7 is an explanatory diagram illustrating configurations of a rolling mill according to a first embodiment of the present invention and a device for controlling the rolling mill.
Figure 8:
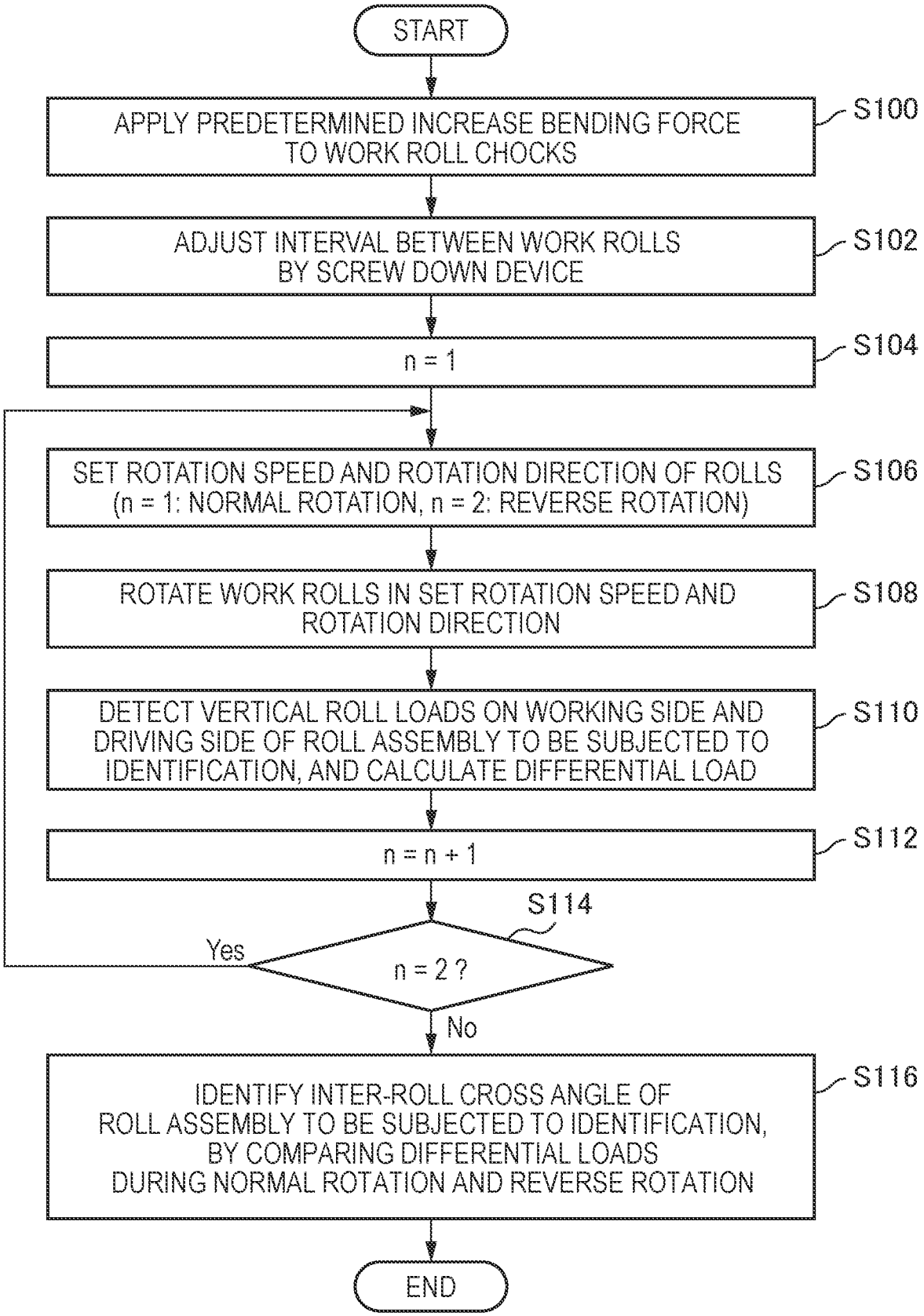
FIG. 8 is a flowchart illustrating inter-roll cross angle identification processing according to the embodiment.
Figure 9:
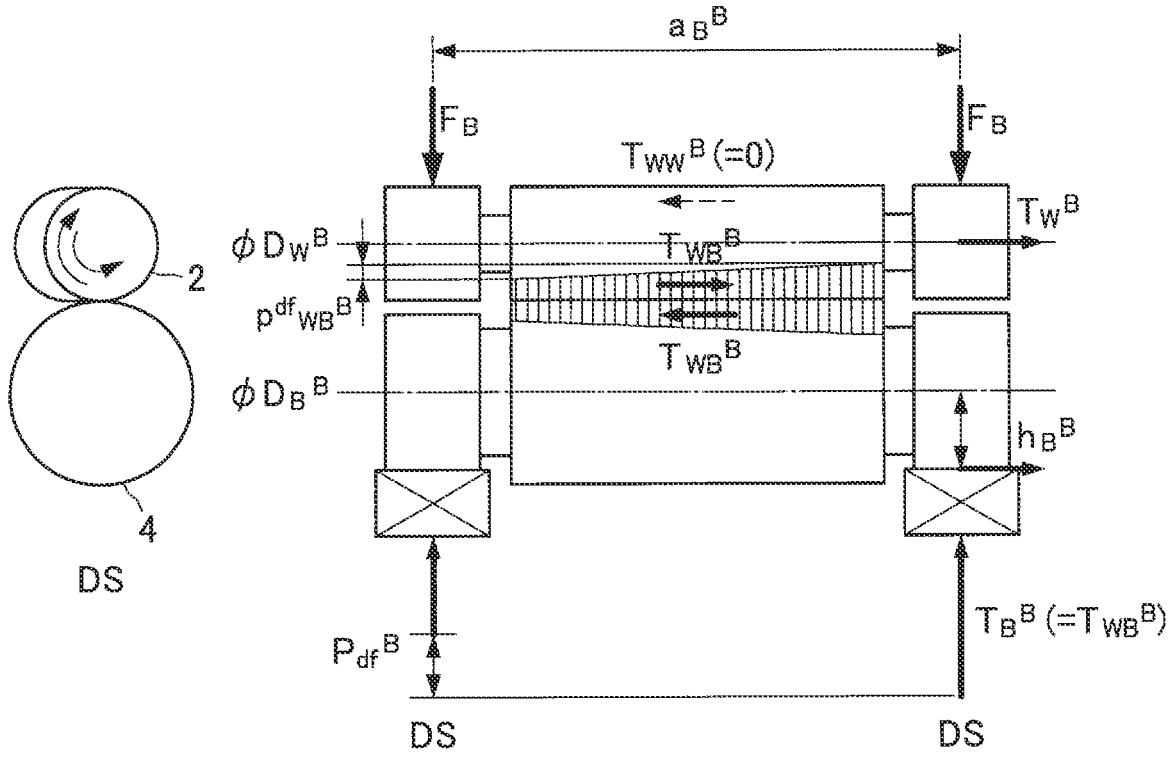
FIG. 9 is an explanatory diagram for describing an inter-roll thrust force generated when an increase bending force is applied to a lower roll assembly.

On the basis of FIG. 7 to FIG. 9, description is given on configurations of a rolling mill according to a first embodiment of the present invention and a device for controlling the rolling mill, and an inter-roll cross angle identification method. The first embodiment is related to an inter-roll cross angle identification method by roll normal rotation/reverse rotation shown in the above (a).

[2-1. Configuration of Rolling Mill]

First, on the basis of FIG. 7, a rolling mill according to the present embodiment and a device for controlling the rolling mill are described. FIG. 7 is an explanatory diagram illustrating configurations of a rolling mill according to the present embodiment and a device for controlling the rolling mill. Note that the rolling mill illustrated in FIG. 7 shows a state seen from the working side in the axial direction of rolls.

The rolling mill illustrated in FIG. 7 is a four-high rolling mill including a pair of work rolls 1 and 2 and a pair of backup rolls 3 and 4 that support them. The upper work roll 1 is supported by an upper work roll chock 5, and the lower work roll 2 is supported by a lower work roll chock 6. Note that the upper work roll chock 5 and the lower work roll chock 6 are provided similarly on the deep side of the paper of FIG. 7 (driving side) as well, and respectively support the upper work roll 1 and the lower work roll 2. The upper work roll 1 and the lower work roll 2 are rotationally driven by a drive electric motor 16. In addition, the upper backup roll 3 is supported by an upper backup roll chock 7, and the lower backup roll 4 is supported by a lower backup roll chock 8. Also the upper backup roll chock 7 and the lower backup roll chock 8 are provided similarly on the deep side of the paper of FIG. 7 (driving side) as well, and respectively support the upper backup roll 3 and the lower backup roll 5. The upper work roll chock 5, the lower work roll chock 6, the upper backup roll chock 7, and the lower backup roll chock 8 are held by a housing 11.

In the vertical direction, an upper vertical roll load detection device 9 and a screw down device 18 are provided at a rolling support position (that is, a position where a load in a perpendicular direction acts on the backup roll chock) 30*a* between the upper backup roll chock 7 and the housing 11, and a lower vertical roll load detection device 10 is provided at a rolling support position 30*b* between the lower backup roll chock 8 and the housing 11. The upper vertical roll load detection device 9 and the lower vertical roll load detection device 10 are provided similarly on the deep side of the paper of FIG. 7 (driving side) as well. In addition, an entry side upper increase bending device 13*a* and an exit side upper increase bending device 13*b* are provided in a project block between the upper work roll chock 5 and the housing 11, and an entry side lower increase bending device 14*a* and an exit side lower increase bending device 14*b* are provided between the lower work roll chock 6 and the housing 11. The entry side upper increase bending device 13*a*, the exit side upper increase bending device 13*b*, the entry side lower increase bending device 14*a*, and the exit side lower increase bending device 14*b* are provided similarly on the deep side of the paper FIG. 7 (driving side) as well.

Each increase bending device applies an increase bending force for raising a contact load between the work roll and the backup roll to the work roll chock. In addition, the rolling mill may include decrease bending devices 23*a*, 23*b*, 24*a*, and 24*b* that each apply a decrease bending force for lowering a contact load between the work roll and the backup roll to the work roll chock.

The rolling mill includes, as devices for controlling the rolling mill, an increase bending control device 15, a drive electric motor control device 17, and an inter-roll cross angle identification device 21, as illustrated in FIG. 7, for example.

The increase bending control device 15 is a device that controls the entry side upper increase bending device 13*a*, the exit side upper increase bending device 13*b*, the entry side lower increase bending device 14*a*, and the exit side lower increase bending device 14*b*. The increase bending control device 15 according to the present embodiment controls the increase bending devices to apply an increase bending force to the work roll chocks, on the basis of an instruction from the inter-roll cross angle identification device 21 described later. Note that also in cases other than the case of executing inter-roll cross angle identification processing according to the present embodiment, the increase bending control device 15 may control the increase bending devices also in performing crown control or shape control of the material to be rolled, for example.

The drive electric motor control device 17 controls the drive electric motor 16 that rotationally drives the upper work roll 1 and the lower work roll 2. The drive electric motor control device 17 according to the present embodiment controls driving of the upper work roll 1 and the lower work roll 2, on the basis of an instruction from the inter-roll cross angle identification device 21 described later. Specifically, the drive electric motor control device 17 performs, for the upper work roll 1 and the lower work roll 2, control of switching between a rotation state and a stop state, rotational driving control of rotation direction and rotation speed, or the like. Note that also in cases other than the case of executing the inter-roll cross angle identification processing according to the present embodiment, the drive electric motor control device 17 may control the upper work roll 1 and the lower work roll 2.

When rolling is not performed, the inter-roll cross angle identification device 21 identifies an inter-roll cross angle present between the work roll and the backup roll on the side where a vertical roll load is detected, on the basis of a detection result of the upper vertical roll load detection device 9 or the lower vertical roll load detection device 10 provided on each of the working side and the driving side. The inter-roll cross angle identification device 21 independently identifies an inter-roll cross angle caused between the work roll and the backup roll, for each of the upper roll assembly including the upper work roll 1 and the upper backup roll and the lower roll assembly including the lower work roll 2 and the lower backup roll 4.

The inter-roll cross angle identification device 21 includes the upper side differential load calculation unit 19 and the lower side differential load calculation unit 20 that calculate a difference between vertical roll loads on the working side and the driving side detected by the vertical roll load detection devices on the side to be subjected to identification, and an identification processing unit 22 that identifies an inter-roll cross angle. In acquiring vertical roll loads, the inter-roll cross angle identification device 21 instructs the increase bending control device 15 to apply a predetermined increase bending force so that a predetermined load acts between the work roll and the backup roll. In addition, the inter-roll cross angle identification device 21 instructs the screw down device 18 to adjust an interval between the upper work roll 1 and the lower work roll 2 to put a roll gap into an open state. Furthermore, the inter-roll cross angle identification device 21 instructs the drive electric motor control device 17 about a driving state of the work roll when detecting vertical roll loads and to control the driving state of the work roll. For example, in the present embodiment, vertical roll loads are detected when the work rolls are normally rotated and when the work rolls are reversely rotated; hence, the inter-roll cross angle identification device 21 outputs an instruction to normally rotate and reversely rotate the work rolls to the drive electric motor control device 17. This roll bending force application processing is performed by the identification processing unit 22.

When vertical roll loads on the working side and the driving side are detected by the vertical roll load detection devices, a differential load is calculated by the upper-side differential load calculation unit 19 for the upper roll assembly, and by the lower-side differential load calculation unit 20 for the lower roll assembly. The identification processing unit 22 identifies an inter-roll cross angle, on the basis of the differential load input from the upper-side differential load calculation unit 19 or the lower-side differential load calculation unit 20. In the case where the inter-roll cross angle is not zero, the inter-roll cross angle identification device 21 adjusts a shim, a liner, or the like on the work roll chock or, housing side to make the identified inter-roll cross angle zero. Alternatively, in the case where a roll cross angle adjustment device or the like is provided, a control device is instructed to adjust the angle by the roll cross angle adjustment device or the like to make the identified inter-roll cross angle zero. Note that detailed description of the inter-roll cross angle identification processing will be given later.

[2-2. Inter-Roll Cross Angle Identification Processing]

On the basis of FIG. 8 and FIG. 9, the inter-roll cross angle identification processing according to the present embodiment is described. Note that FIG. 8 is a flowchart illustrating the inter-roll cross angle identification processing according to the present embodiment. FIG. 9 is an explanatory diagram for describing an inter-roll thrust force generated when an increase bending force is applied to the lower roll assembly. Note that the following description describes the case of identifying an inter-roll cross angle of the lower roll assembly, but the same applies to the case of identifying an inter-roll cross angle of the upper roll assembly.

(Initial Setting: S100 to S102)

In performing the inter-roll cross angle identification processing, first, the inter-roll cross angle identification device 21 instructs the increase bending control device 15 to apply a predetermined increase bending force to the work roll chocks by the increase bending devices (S100). The increase bending control device 15 controls each increase bending device on the basis of the instruction to apply a predetermined increase bending force to the work roll chock.

In addition, the inter-roll cross angle identification device 21 instructs the screw down device 18 to adjust an interval between the upper work roll 1 and the lower work roll 2 to put a roll gap between the work rolls into an open state (S102). This makes vertical roll loads detectable. Note that whichever of step S100 and step S102 may be executed first.

(Acquisition of Vertical Roll Loads and Calculation of Differential Load: S104 to S114)

Next, vertical roll loads necessary for identifying an inter-roll cross angle are acquired and the differential load is calculated. In the present embodiment, vertical roll loads on the working side and the driving side are detected during normal rotation and reverse rotation. Here, a coefficient n indicating a roll rotation state is set to 1 for during normal rotation, and is set to 2 for during reverse rotation.

First, vertical roll loads during normal rotation are detected. The inter-roll cross angle identification device 21 sets the coefficient n to 1 (S104), and sets a rotation speed and a rotation direction of the work rolls as roll rotation conditions (S106). Then, the inter-roll cross angle identification device 21 outputs the set rotation speed and rotation direction of the work rolls to the drive electric motor control device 17 to cause the work rolls to be rotated under these roll rotation conditions (S108). When the work rolls are rotated, the load detection devices detect vertical roll loads on the working side and the driving side of the roll assembly to be subjected to identification, and the differential load calculation unit calculates the differential load (S110). The acquired differential load during normal rotation is input to the inter-roll cross angle identification device 21. Then, 1 is added to the coefficient n (S112).

Next, the inter-roll cross angle identification device 21 determines whether or not the coefficient n is 2 (S114). The case where the coefficient n is 2 is the case of detecting vertical roll loads during reverse rotation. That is, in step S114, it is determined whether or not to execute processing of detecting vertical roll loads during reverse rotation. When the coefficient n is 2, the inter-roll cross angle identification device 21 returns to step S106, and executes the processing of step S106 to S110 for during reverse rotation. Note that this processing is the same as during normal rotation; hence, description is omitted. Then, when a differential load during reverse rotation is acquired and input to the inter-roll cross angle identification device 21, 1 is further added to the coefficient n (S112). Consequently, when differential loads during normal rotation and reverse rotation are acquired, the coefficient n is 3.

Then, when the coefficient n is determined not to be 2 in the determination of the coefficient n in step S114, that is, when differential loads during normal rotation and reverse rotation are acquired, the inter-roll cross angle identification device 21 executes processing of step S116.

(Inter-Roll Cross Angle Identification: S116)

The inter-roll cross angle identification device 21 identifies an inter-roll cross angle, on the basis of differential loads during normal rotation and reverse rotation (S116). Hereinafter, on the basis of FIG. 9, identification of an inter-roll cross angle will be described. Here, the case of identifying an inter-roll cross angle of the lower roll assembly is described. Note that an inter-roll cross angle of the upper roll assembly may also be identified in a similar manner.

(A) Acquisition of Relationship Between Difference Between Vertical Roll Loads and Inter-Roll Thrust Force FIG. 9 shows a relationship diagram of an inter-roll thrust force generated when an increase bending force is applied to the work roll chocks in the lower roll assembly. The relationship between an inter-roll (work roll-backup roll) thrust force $T_{WB}^{B}$ in the lower roll assembly, and a load difference $P_{df}^{B}$ in the vertical direction can be expressed by the following formula (1). Here, $D_{W}^{B}$ is a diameter of the lower work roll, $D_{B}^{B}$ is a diameter of the lower backup roll, $h_{B}^{B}$ is the distance between a position of a point of the thrust counter force acting on the lower backup roll and the axial center of it and $a_{B}^{B}$ is a distance between supports of the lower roll assembly. As described in Patent Literature 1, the following formula (1) is derived from an equilibrium condition expression of moments of the lower work roll and the lower backup roll expressed by the following formulas (1-1) and (1-2). At this time, a thrust force $T_{WW}$ that acts between the upper work roll and the lower work roll, a length $l_{WW}$ in the axial direction of rolls of a contact region between the upper work roll and the lower work roll, and a difference $p^{df}_{WW}$, between the working side and the driving side, in line load distribution between the upper and lower work rolls are zero, because a roll gap between the work rolls is in an open state. Then, the following formula (1) is obtained by deleting, from formula (1-1) and formula (1-2), a difference $p^{df}_{WB}{}^{B}$, between the working side and the driving side, in line load distribution between the lower work roll and the lower backup roll and a length $l_{WB}^{B}$ in the axial direction of rolls of a contact region between the lower work roll and the lower backup roll, which are unknowns.

[Math. 1]

$$P_{df}^{B} = \frac{-T_{WB}^{B}(D_{W}^{B} + D_{B}^{B} + 2h_{B}^{B}}{a_{B}^{B}} \tag{1}$$

$$T_{WB}^{B} \cdot D_{W}^{B}/2 + T_{WW} \cdot D_{W}^{B}/2 + p^{df\,B}_{WB}(l_{WB}^{B})^{2}/12 - p_{WW}^{df}(l_{WW})^{2}/12 = 0 \tag{1-1}$$

$$T_{WB}^{B} \cdot (D_{B}^{B}/2 + h_{B}^{B}) - p^{df\,B}_{WB}(l_{WB}^{B})^{2}/12 = -P_{df}^{B} \cdot a_{B}^{B}/2 \tag{1-2}$$

Note that the position of the point $h_{B}^{B}$ of the thrust counterforce acting on the lower backup roll is a position of a point in the case where a thrust counterforce that acts on the backup roll of the lower roll assembly is regarded as a concentrated load, as illustrated in FIG. 9, and is defined as a distance from an axial center of the backup roll when a direction of going away from the material to be rolled in the vertical direction is assumed to be a positive direction. Here, moreover, a thrust force $T_{B}^{B}$ that acts between the lower work roll and the lower backup roll balances with a force in an axial direction of the aforementioned thrust counterforce $T_{WB}^{B}$; hence, $T_{B}^{B}=T_{WB}^{B}$ holds. The backup roll chock is supported by a screw down device or the like (hereinafter, also referred to as "screw down system") when a load in the vertical direction is acting; hence, a thrust counterforce that acts on the backup roll is likely to be supported by not only the axial center of the backup roll but also the screw down system. In the present invention, a distance between a position where a thrust counterforce that acts on the backup roll acts and a position of the axial center of the backup roll in a perpendicular direction is defined as the position of the point of the thrust counterforce acting on the backup roll. Thus, an inter-roll thrust force can be precisely calculated from a load difference in the vertical direction, and as a result, an inter-roll cross angle can be identified accurately. A position of a point of a thrust counterforce acting on the backup roll in the upper roll assembly can also be defined like the position of the point of the thrust counterforce acting on the backup roll in the lower roll assembly.

In addition, in general, a thrust force $T_{WB}$ caused by an inter-roll cross angle between the work roll and the backup roll is expressed by the following formula (2).

[Math. 2]

$$T_{WB}=P\mu_T \tag{2}$$

Here, P is a vertical roll load that acts between the work roll and the backup roll, and $\mu_T$ is a thrust coefficient. The thrust coefficient $\mu_T$ is a coefficient indicating a rate of generation of an inter-roll thrust force with respect to a load, and for example, can be expressed as a function of a relative cross angle φ between the work roll and the backup roll, an inter-roll frictional coefficient μ, an inter-roll line load p, a Poisson ratio v of rolls, a Young's modulus G, a work roll diameter $D_W$, and a backup roll diameter $D_B$, as shown in the formula (2) of Patent Literature 2 above. Here, the above formula (2) is expressed like the following formula (3).

[Math. 3]

$$\mu_T=\mu_T(\varphi,\mu,p,\gamma,G,D_W,D_B) \tag{3}$$

In the present embodiment, considered is generation of an inter-roll thrust force generated in the case where a roll gap between the upper work roll and the lower work roll is put into an open state and an increase bending force is applied. Consequently, the vertical roll load P is twice ($P=2F_B$) an increase bending force $F_B$ that acts per work roll chock. Thus, the above formula (2) is expressed by the following formula (4).

[Math. 4]

$$T_{WB}=2F_B\mu_T \tag{4}$$

Then, when a load difference in the vertical direction during normal rotation of the lower roll assembly is $P_{df1}{}^B$, an inter-roll thrust force caused by an inter-roll cross angle between the work roll and the backup roll is $T_{WB1}{}^B$, and an increase bending force is $F_{B1}$, a relational expression between a difference between vertical roll loads and an inter-roll thrust force, expressed by the following formula (5), is obtained from the above formulas (1) to (4).

[Math. 5]

$$P_{df1}^B = -T_{WB1}^B(D_W^B + D_B^B + 2h_B^B)/a_B^B = -2F_{B1}\mu_{T1}(\phi, \mu, p_1, \gamma, G, D_W^B, D_B^B)(D_W^B + D_B^B + 2h_B^B)/a_B^B \tag{5}$$

Here, $p_1=2F_{B1}/L_{WB}{}^B$, and $L_{WB}{}^B$ indicates the contact length between the lower work roll and the lower backup roll. In the formula (5), when $P_{df1}{}^B$ and $F_{B1}$ are set to measurement values, and μ, $L_{WB}{}^B$, v, G, $D_W{}^B$, $D_B{}^B$, and $h_B{}^B$ are set to known values, the inter-roll cross angle φ, which is an unknown, can be obtained. Note that μ, v, and G are given as being common to the upper roll assembly and the lower roll assembly, but may be given individually in the case where characteristics are different between the work roll and the backup roll, or the case where characteristics are different between the upper and lower roll assemblies.

(B) Identification of Inter-Roll Cross Angle

In the present embodiment, an inter-roll cross is identified by comparing values of differential loads during normal rotation and reverse rotation. The above formula (5) expresses the relationship between a difference between vertical roll loads and an inter-roll thrust force during normal rotation; similarly, a relational expression between a difference between vertical roll loads and an inter-roll thrust force during reverse rotation is like the following formula (6). Note that a load difference in the vertical direction of the lower roll assembly during reverse rotation is $P_{df2}{}^B$, an inter-roll thrust force caused by an inter-roll cross angle between the work roll and the backup roll is $T_{WB2}{}^B$, and an increase bending force is $F_{B2}$.

[Math. 6]

$$P_{df2}^B = -T_{WB2}^B(D_W^B + D_B^B + 2h_B^B)/a_B^B = -2F_{B2}\mu_{T2}(\phi, \mu, p_2, \gamma, G, D_W^B, D_B^B)(D_W^B + D_B^B + 2h_B^B)/a_B^B \tag{6}$$

Here, when increase bending forces during normal rotation and reverse rotation are assumed to be the same value, inter-roll thrust forces are values of the same magnitude and different signs during normal rotation and reverse rotation. Thus, the following formula (7) is obtained.

[Math. 7]

$$\begin{cases} F_{B1} = F_{B2} \\ T_{WB1}^B = -T_{WB2}^B \end{cases} \tag{7}$$

Then, a difference between the above formulas (5) and (6) is taken, and substituted into the above formula (7); thus, the following formula (8) is obtained.

[Math. 8]

$$P_{df1}^B - P_{df2}^B = -2T_{WB1}^B(D_W^B + D_B^B + 2h_B^B)/a_B^B = -4F_{B1}\mu_{T1}(\phi, \mu, p_1, \gamma, G, D_W^B, D_B^B)(D_W^B + D_B^B + 2h_B^B)/a_B^B \tag{8}$$

As described above, an inter-roll cross angle between the work roll and the backup roll can be identified by comparing values of differential loads during normal rotation and reverse rotation. The inter-roll cross angle is identified by using a relative change in differential loads during normal rotation and reverse rotation, which can exclude the influence of disturbance such as a zero point of a load measurement value being shifted, and moreover, is effective in the case where an increase bending force is small, because the change in differential load is large.

Returning to the description of FIG. 8, when an inter-roll cross angle is identified by the above calculation in step S116, the inter-roll cross angle identification device 21 adjusts a shim, a liner, or the like on the work roll chock or housing side to make the inter-roll cross angle zero on the basis of an identification result of an inter-roll cross. Alternatively, in the case where a roll cross angle adjustment device or the like is provided, the inter-roll cross angle identification device 21 outputs an instruction to adjust the angle to the roll cross angle adjustment device or the like to make the identified inter-roll cross angle zero. This can eliminate an inter-roll cross angle, and exclude left-right asymmetric deformation due to an inter-roll thrust force. As a result, a product without zigzagging and camber or with very minor zigzagging and camber can be stably produced.

3. Second Embodiment

Next, an inter-roll cross angle identification method according to a second embodiment of the present invention is described. The second embodiment is related to an inter-roll cross angle identification method using a load difference between when rotation of rolls is stopped and when rolls are rotated, shown in the above (b). Note that a rolling mill and a device for controlling the rolling mill according to the present embodiment have the same configurations as those in the first embodiment illustrated in FIG. 7; hence, description is omitted here.

Figure 10:
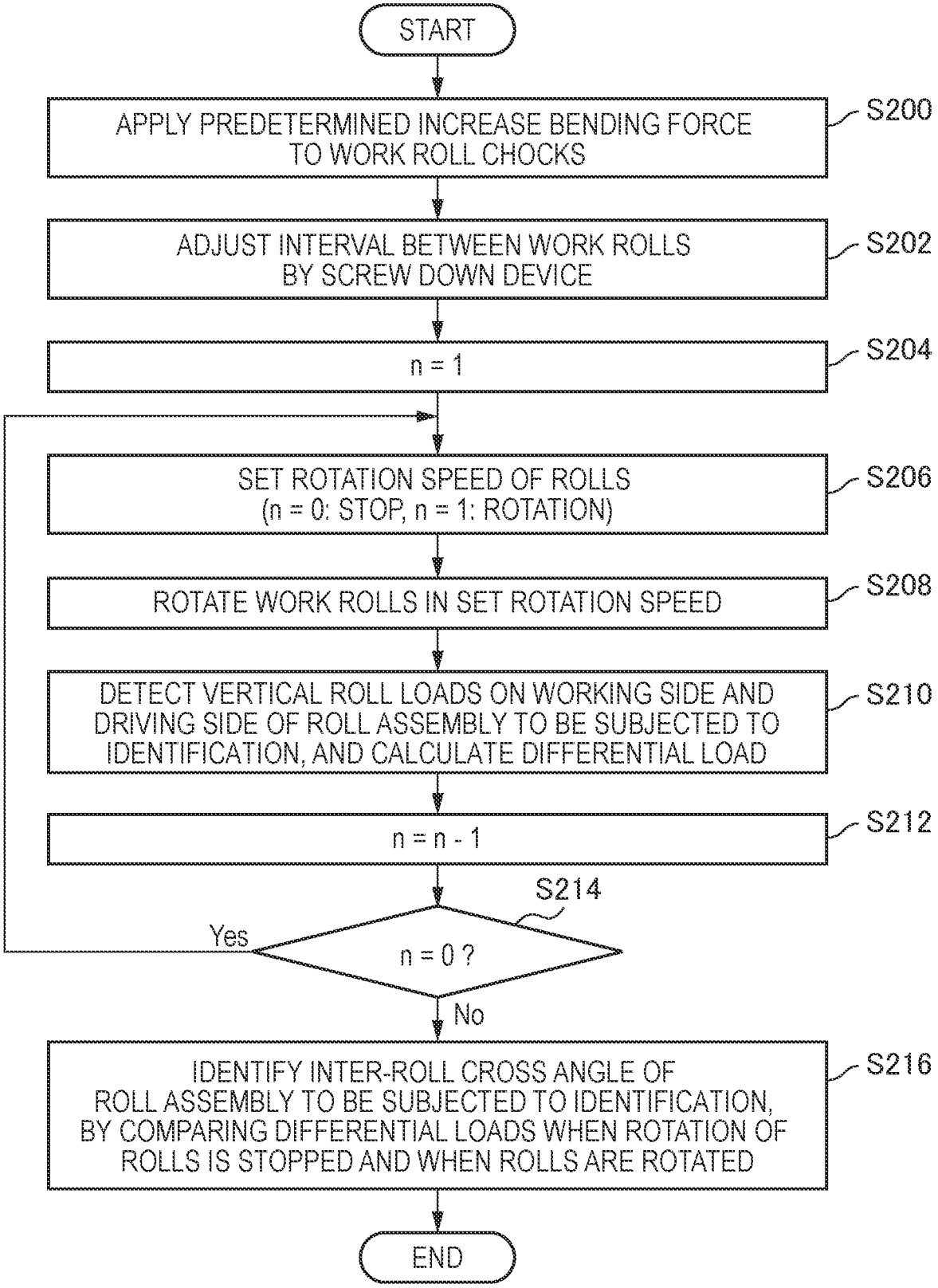
FIG. 10 is a flowchart illustrating inter-roll cross angle identification processing according to a second embodiment of the present invention.

On the basis of FIG. 10, inter-roll cross angle identification processing according to the present embodiment is described. FIG. 10 is a flowchart illustrating the inter-roll cross angle identification processing according to the present embodiment. Also in the present embodiment, the following description describes the case of identifying an inter-roll cross angle of the lower roll assembly, but the same applies to the case of identifying an inter-roll cross angle of the upper roll assembly.

(Initial Setting: S200 to S202)

In performing the inter-roll cross angle identification processing, first, the inter-roll cross angle identification device 21 instructs the increase bending control device 15 to apply a predetermined increase bending force to the work roll chocks by the increase bending devices (S200). The increase bending control device 15 controls each increase bending device on the basis of the instruction to apply a predetermined increase bending force to the work roll chock.

In addition, the inter-roll cross angle identification device 21 instructs the screw down device 18 to adjust an interval between the upper work roll 1 and the lower work roll 2 to put a roll gap between the work rolls into an open state (S202). This makes vertical roll loads detectable. Note that whichever of step S200 and step S202 may be executed first. Thus, the processing of steps S200 and S202 is performed as in the steps S100 and 102 in the inter-roll cross angle identification processing of the first embodiment.

(Acquisition of Vertical Roll Loads and Calculation of Differential Load: S204 to S214)

Next, vertical roll loads necessary for identifying an inter-roll cross angle are acquired and the differential load is calculated. In the present embodiment, vertical roll loads on the working side and the driving side are detected when the rolls are at a stop and when the rolls are rotated. Here, a coefficient n indicating a roll rotation state is set to 0 for when the rolls are at a stop, and is set to 1 for when the rolls are rotated.

First, vertical roll loads when the rolls are rotated are detected. The inter-roll cross angle identification device 21 sets the coefficient n to 1 (S204), and sets a rotation speed of the work rolls as roll rotation condition (S206). Then, the inter-roll cross angle identification device 21 outputs the set rotation speed of the work rolls to the drive electric motor control device 17 to cause the work rolls to be rotated under these roll rotation conditions (S208). When the work rolls are rotated, the load detection devices detect vertical roll loads on the working side and the driving side of the roll assembly to be subjected to identification, and the differential load calculation unit calculates the differential load (S210). The acquired differential load when the rolls are rotated is input to the inter-roll cross angle identification device 21. Then, 1 is subtracted from the coefficient n (S212).

Next, the inter-roll cross angle identification device 21 determines whether or not the coefficient n is 0 (S214). The case where the coefficient n is 0 is the case of detecting vertical roll loads when the rolls are at a stop. That is, in step S214, it is determined whether or not to execute processing of detecting vertical roll loads when the rolls are at a stop. When the coefficient n is 0, the inter-roll cross angle identification device 21 returns to step S206, and executes the processing of step S206 to S210 for when the rolls are at a stop. In detection of vertical roll loads when the rolls are at a stop, a rotation speed of the work rolls set in step S206 is zero. Consequently, the work rolls are not rotated in step S208. In such a state, vertical roll loads on the working side and the driving side are detected in step S210, and a differential load is calculated. Then, when a differential load when the rolls are at a stop is acquired and input to the inter-roll cross angle identification device 21, 1 is further subtracted from the coefficient n (S212). Consequently, when differential loads when the rolls are rotated and when the rolls are at a stop are acquired, the coefficient n is −1.

Then, when the coefficient n is determined not to be 0 in the determination of the coefficient n in step S214, that is, when differential loads when the rolls are rotated and when the rolls are at a stop are acquired, the inter-roll cross angle identification device 21 executes processing of step S216.

(Inter-Roll Cross Angle Identification: S216)

The inter-roll cross angle identification device 21 identifies an inter-roll cross angle, on the basis of differential loads when the rolls are rotated and when the rolls are at a stop (S216). Here, on the basis of FIG. 9, identification of an inter-roll cross angle is described. Here, the case of identifying an inter-roll cross angle of the lower roll assembly is described. Note that an inter-roll cross angle of the upper roll assembly may also be identified in a similar manner.

Also in the present embodiment, as in the first embodiment, first, the relationship between a difference between vertical roll loads and an inter-roll thrust force is acquired. This arithmetic processing is the same as arithmetic processing described in "(A) Acquisition of relationship between difference between vertical roll loads and inter-roll thrust force" of the first embodiment; hence, description is omitted here.

The relationship between a difference between vertical roll loads and an inter-roll thrust force when the rolls are rotated is expressed by the relationship between the difference between vertical roll loads and the inter-roll thrust force expressed by the above formula (5). On the other hand, when the rolls are at a stop, an inter-roll thrust force is not generated even if an inter-roll cross angle is present. Thus, the relationship in the following formula (9) holds.

[Math. 9]

$$T_{WB0}{}^{B}=0 \tag{9}$$

Then, when increase bending forces when the rolls are at a stop and when the rolls are rotated are assumed to be the same value, a relational expression between a difference between vertical roll loads and an inter-roll thrust force when the rolls are at a stop is like the following formula (10) according to the above formula (1), formula (5), and formula (9). Note that a vertical roll load difference when the rolls are at a stop of the lower roll assembly is $P_{df0}{}^{B}$, an inter-roll thrust force caused by an inter-roll cross angle between the work roll and the backup roll is $T_{WB0}{}^{B}$, and an increase bending force is $F_{B0}$.

[Math. 10]

$$P_{df1}^{B} - P_{df0}^{B} = -T_{WB1}^{B}(D_{W}^{B} + D_{B}^{B} + 2h_{B}^{B})/a_{B}^{B} = -2F_{B1}\mu_{T1}(\phi, \mu, p_1, \gamma, G, D_{W}^{B}, D_{B}^{B})(D_{W}^{B} + D_{B}^{B} + 2h_{B}^{B})/a_{B}^{B} \quad (10)$$

As described above, an inter-roll cross angle between the work roll and the backup roll can be identified by comparing values of differential loads when the rolls are at a stop and when the rolls are rotated. The inter-roll cross angle is identified by using a relative change in differential load between when the rolls are at a stop and when the rolls are rotated, which can exclude the influence of disturbance such as a zero point of a load measurement value being shifted. In addition, as compared with the first embodiment, measurement with a work roll rotation direction changed is unnecessary, which can shorten identification work. Note that the above description gives description assuming that rolls are normally rotated when the rolls are rotated, but it is needless to say that similar effects are obtained even in the case where rolls are reversely rotated when the rolls are rotated.

Returning to the description of FIG. 10, when an inter-roll cross angle is identified by the above calculation in step S216, the inter-roll cross angle identification device 21 adjusts a shim, a liner, or the like on the work roll chock or housing side to make the inter-roll cross angle zero on the basis of an identification result of an inter-roll cross. Alternatively, in the case where a roll cross angle adjustment device or the like is provided, the inter-roll cross angle identification device 21 outputs an instruction to adjust the angle to the roll cross angle adjustment device or the like to make the identified inter-roll cross angle zero. This can eliminate an inter-roll cross angle, and exclude left-right asymmetric deformation due to an inter-roll thrust force. As a result, a product without zigzagging and camber or with very minor zigzagging and camber can be stably produced.

4. Third Embodiment

Next, an inter-roll cross angle identification method according to a third embodiment of the present invention is described. The present embodiment is related to a method capable of further identifying, in addition to an inter-roll cross angle, an inter-roll frictional coefficient and a position of a point of a thrust counterforce acting on the backup roll. Also in the present embodiment, as in the first and second embodiments, in a state where a roll gap between the work rolls is put into an open state and an increase bending force is applied to the work roll chocks, a difference between vertical roll loads in two roll rotation states (e.g., normal rotation and reverse rotation, or rotation and stop) is acquired. At this time, differences between vertical roll loads at a plurality of levels are acquired by changing the increase bending force. This makes it possible to identify not only an inter-roll cross angle but also other unknowns.

Figure 11:
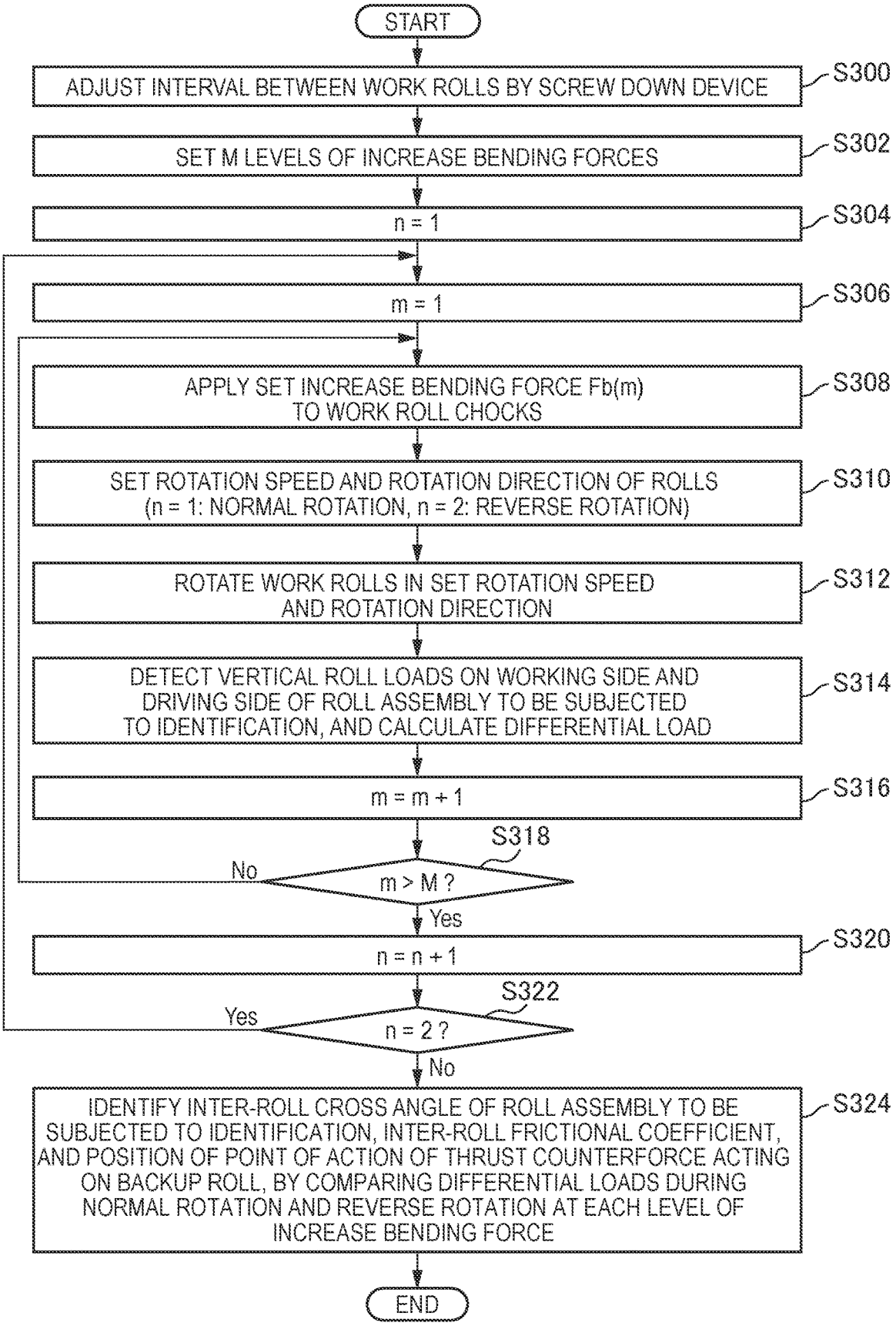
FIG. 11 is a flowchart illustrating identification processing according to a third embodiment of the present invention.

On the basis of FIG. 11, identification processing according to the present embodiment is described. FIG. 11 is a flowchart illustrating the identification processing according to the present embodiment. Note that a rolling mill and a device for controlling the rolling mill according to the present embodiment have the same configurations as those in the first embodiment illustrated in FIG. 7; hence, description is omitted here. In the present embodiment, description is given on the case of identifying an inter-roll cross angle, an inter-roll frictional coefficient, and a position of a point of a thrust counterforce acting on the backup roll of the lower roll assembly, but the same applies to the case of identification about the lower roll assembly. In addition, in the present embodiment, detection of vertical roll loads is performed during normal rotation and reverse rotation, as in the first embodiment, but the present invention is not limited to this example; as in the second embodiment, the detection may be performed when the rolls are at a stop and when the rolls are rotated.

(Initial Setting: S300 to S302)

In performing the inter-roll cross angle identification processing, first, the inter-roll cross angle identification device 21 instructs the screw down device 18 to adjust an interval between the upper work roll 1 and the lower work roll 2 (S300). In addition, the inter-roll cross angle identification device 21 sets increase bending forces whose number of levels is M, and outputs them to the increase bending control device 15 (S302). The number of levels of the increase bending forces is set in accordance with the number of values to be identified. For example, M is 2 in the case of identifying an inter-roll cross angle and an inter-roll frictional coefficient, and M is 3 in the case of identifying an inter-roll cross angle, an inter-roll frictional coefficient, and a position of a point of a thrust counterforce acting on the backup roll.

(Acquisition of Vertical Roll Loads and Calculation of Differential Load: S304 to S322)

Next, vertical roll loads necessary for identifying an inter-roll cross angle are acquired and the differential load is calculated. In the present embodiment, an increase bending force applied to the work roll chocks is changed between a plurality of levels, and vertical roll loads on the working side and the driving side during normal rotation and reverse rotation are detected. Here, a coefficient n indicating a roll rotation state is set to 1 for during normal rotation, and is set to 2 for during reverse rotation. In addition, a coefficient m is a positive integer (1 to M) indicating a level of the increase bending force. In the present embodiment, M is 3.

First, vertical roll loads during normal rotation at the first level are detected. The inter-roll cross angle identification device 21 sets the coefficient n to 1 (S304), and sets the coefficient m to 1 (S306). Then, the increase bending control device 15 applies a first-level increase bending force $F_B(1)$ to the work roll chocks (S308). This makes vertical roll loads detectable. Furthermore, the inter-roll cross angle identification device 21 sets a rotation speed and a rotation direction of the work rolls as roll rotation conditions (S310), and the drive electric motor control device 17 rotates the work rolls under these roll rotation conditions (S312). When the work rolls are rotated, the load detection devices detect vertical roll loads on the working side and the driving side of the roll assembly to be subjected to identification, and the differential load calculation unit calculates the differential load (S314). The acquired differential load during normal rotation is input to the inter-roll cross angle identification device 21. Then, 1 is added to the coefficient m (S316).

Next, the inter-roll cross angle identification device 21 determines whether or not the coefficient m is larger than M (S318). The case where the coefficient m is larger than M is the case where differences between vertical roll loads under M-level increase bending forces set in step S302 are acquired. That is, in step S318, it is checked whether or not differences between vertical roll loads at all the set levels are acquired. In the case where the coefficient m is M or less, returning to step S308, the increase bending control device 15 applies a second-level increase bending force $F_B$(2) to the work roll chocks (S308), and detection of vertical roll loads during normal rotation and calculation of the differential load are performed (S314).

After that, 1 is further added to the coefficient m (S316), and m becomes 3. The inter-roll cross angle identification device 21 returns to step S308, because the determination requirement in step S318 is not satisfied, the increase bending control device 15 applies a third-level increase bending force $F_B$(3) to the work roll chocks (S308), and detection of vertical roll loads during normal rotation and calculation of the differential load are performed (S314). Then, when 1 is added to the coefficient m (S316) and m becomes 4, the determination requirement in step S318 is satisfied; hence, the inter-roll cross angle identification device 21 goes to processing of step S320, and adds 1 to the coefficient n (S320). Then, the inter-roll cross angle identification device 21 determines whether or not the coefficient n is 2 (S322).

In step S322, it is determined whether or not to execute processing of detecting vertical roll loads during reverse rotation. When the coefficient n is 2, the inter-roll cross angle identification device 21 returns to step S306, resets the coefficient m to 1, and then executes the processing of step S308 to S320 for during reverse rotation. Note that this processing is the same as during normal rotation; hence, description is omitted. Then, when differential loads during reverse rotation are acquired for three levels, 1 is further added to the coefficient n (S320). Consequently, when differential loads during normal rotation and reverse rotation are acquired, the coefficient n is 3.

Then, when the coefficient n is determined not to be 2 in the determination of the coefficient n in step S322, that is, when differential loads during normal rotation and reverse rotation are acquired, the inter-roll cross angle identification device 21 executes processing of step S324.

(Inter-Roll Cross Angle Identification: S324)

The inter-roll cross angle identification device 21 identifies an inter-roll cross angle, an inter-roll frictional coefficient, and a position of a point of a thrust counterforce acting on the backup roll, on the basis of differential loads during normal rotation and reverse rotation (S324). Hereinafter, on the basis of FIG. 9, identification of the inter-roll cross angle, the inter-roll frictional coefficient, and the position of the point of the thrust counterforce acting on the backup roll will be described. Here, the case of identifying values of the lower roll assembly is described, but values of the upper roll assembly may be identified in a similar manner. In addition, a processing flow in FIG. 11 illustrates the case of acquiring differential loads for three-level (M=3) increase bending forces, but the following description shows the case of two levels or more (M≥2) for more versatility.

Also in the present embodiment, as in the first embodiment, first, the relationship between a difference between vertical roll loads and an inter-roll thrust force is acquired. This arithmetic processing is the same as arithmetic processing described in "(A) Acquisition of relationship between difference between vertical roll loads and inter-roll thrust force" of the first embodiment; hence, description is omitted here. Then, when M-level increase bending forces applied during normal rotation and reverse rotation are $F_{B1}$(1) to $F_{B1}$(M) and $F_{B2}$(1) to $F_{B2}$(M), according to the above formula (8), a relational expression group between a relative change during normal rotation and reverse rotation at each level of the increase bending force, and an inter-roll thrust force caused by an inter-roll cross angle between the work roll and the backup roll can be expressed like the following formula (11).

[Math. 11]

$$\begin{cases} P^B_{df1}(1) - P^B_{df2}(1) = -2T^B_{WB1}(1)(D^B_W + D^B_B + 2h^B_B)/a^B_B = - \\ 4F_{B1}(1)\mu_{T1}(\phi, \mu, p_1(1), \gamma, G, D^B_W, D^B_B)(D^B_W + D^B_B + 2h^B_B)/a^B_B \\ \vdots \\ \vdots \\ P^B_{df1}(M) - P^B_{df2}(M) = -2T^B_{WB1}(M)(D^B_W + D^B_B + 2h^B_B)/a^B_B = - \\ 4F_{B1}(M)\mu_{T1}(\phi, \mu, p_1(M), \gamma, G, D^B_W, D^B_B)(D^B_W + D^B_B + 2h^B_B)/a^B_B \end{cases} \quad (11)$$

Here, $P_{df1}{}^B$(1)−$P_{df2}{}^B$(1) to $P_{df1}{}^B$(M)−$P_{df2}{}^B$(M) are differences between vertical roll loads during normal rotation and reverse rotation when increase bending forces of the respective levels (m=1 to M) are applied, and $T_{WB1}{}^B$(1) to $T_{WB1}{}^B$(M) are inter-roll thrust forces when increase bending forces of the respective levels (m=1 to M) are applied, and $p_1$(1) to $p_1$(M) are inter-roll line loads when increase bending forces of the respective levels (m=1 to M) are applied.

According to the formula (11), in the case where increase bending forces of two levels (M=2) or more are set, the number of equations is two or more. Consequently, as unknowns, two or more can be set including, in addition to the inter-roll cross angle, at least one of the inter-roll frictional coefficient or the position of the point of the thrust counterforce acting on the backup roll. In the case where increase bending forces of three levels (M=3) or more are set, the number of equations is three or more. Consequently, as unknowns, three or more can be set including, in addition to the inter-roll cross angle, the inter-roll frictional coefficient and the position of the point of the thrust counterforce acting on the backup roll. Note that in the case where increase bending forces of more than three levels are set, the number of equations exceeds the number of unknowns; in this case, a solution can be obtained by obtaining a least squares solution.

As described above, in the present embodiment, the inter-roll frictional coefficient and the position of the point of the thrust counterforce acting on the backup roll can be identified in addition to identification of the inter-roll cross angle, by increasing load levels of increase bending forces and comparing values of differential loads during normal rotation and reverse rotation. Since these values that change over time can be identified, the inter-roll cross angle can be identified with higher precision.

Returning to the description of FIG. 11, in step S324, the inter-roll cross angle, the inter-roll frictional coefficient, and the position of the point of the thrust counterforce acting on the backup roll are identified by the above calculation, by comparing differential loads during normal rotation and reverse rotation acquired with increase bending forces of three levels (M=3) set. The inter-roll cross angle identification device 21 adjusts a shim, a liner, or the like on the work roll chock or housing side to make the inter-roll cross angle zero on the basis of an identification result of an inter-roll cross. Alternatively, in the case where a roll cross angle adjustment device or the like is provided, the inter-roll cross angle identification device 21 outputs an instruction to adjust the angle to the roll cross angle adjustment device or the like to make the identified inter-roll cross angle zero. This can eliminate an inter-roll cross angle, and exclude left-right asymmetric deformation due to an inter-roll thrust force. As a result, a product without zigzagging and camber or with very minor zigzagging and camber can be stably produced.

Example 1

For fifth to seventh stands of a hot finish rolling mill with a configuration illustrated in FIG. 7, a conventional method and the method of the present invention were compared in regard to reduction leveling setting considering the influence of an inter-roll thrust force due to an inter-roll cross angle.

First, in the conventional method, a housing liner and a chock liner were replaced at regular intervals, and facility management was performed to prevent an inter-roll cross angle from being caused. As a result, when a thin-wide material with an exit side thickness of 1.2 mm and a width of 1200 mm was rolled as a material to be rolled at a timing immediately before replacement of the housing liner, thickness wedge and camber occurred, and squeezing due to zigzagging occurred in the sixth stand.

On the other hand, in the method of the present invention, when rolling was not performed, a roll bending force was applied to the work roll chocks with a roll gap put into an open state, and an inter-roll cross angle was identified by comparing differences between vertical roll loads on the working side and the driving side for when the rolls were normally rotated and when the rolls were reversely rotated. Then, on the basis of an identification result, a shim or the like was inserted between the liner on the work roll chock side and the work roll chock, and adjustment was performed to reduce the inter-roll cross angle. As a result, even at a timing immediately before replacement of the housing liner, even in the case where a thin-wide material with an exit side thickness of 1.2 mm and a width of 1200 mm was rolled, in which squeezing occurred in the conventional method, occurrence of thickness wedge and camber was less, and the material to be rolled was able to be threaded straightly to a rolling line.

As described above, the method of the present invention can identify an inter-roll cross angle, without need for a thrust counterforce measurement device. In addition, adjusting the inter-roll cross angle on the basis of an identification result can exclude left-right asymmetric deformation due to an inter-roll thrust force caused to be generated by the inter-roll cross angle, which makes it possible to stably produce a flat-rolled metal material without zigzagging and camber or with very minor zigzagging and camber.

Example 2

In a hot plate rolling mill with a configuration illustrated in FIG. 7, a conventional method and the method of the present invention were compared in regard to reduction leveling setting considering the influence of a thrust force due to an inter-roll cross angle.

First, in the conventional method, a housing liner and a chock liner were replaced at regular intervals, and facility management was performed to prevent an inter-roll cross angle from being caused.

On the other hand, in the method of the present invention, when rolling was not performed, two-level roll bending forces were set with a roll gap put into an open state, and an inter-roll cross angle and an inter-roll frictional coefficient were identified by comparing differences between vertical roll loads on the working side and the driving side for when the rolls were at a stop and when the rolls were rotated. Then, on the basis of an identification result, a shim or the like was inserted between the liner on the work roll chock side and the work roll chock, and adjustment was performed to reduce the inter-roll cross angle.

Table 1 shows, in regard to the present invention and the conventional method, actual values of camber occurrence with respect to a typical number of coils. Among camber actual values per 1 m of a tip of the material to be rolled, a value immediately before backup roll recombination and immediately before housing liner replacement is controlled to a value as relatively small as 0.12 mm/m in the case of the present invention. In contrast, in the case of the conventional method, the camber actual value is larger as compared with the case of the present invention at timing immediately before backup roll recombination and immediately before housing liner replacement.

As described above, the device of the present invention can identify an inter-roll cross angle without need for a thrust counterforce measurement device, and also identify an inter-roll frictional coefficient that changes over time. Adjusting the inter-roll cross angle on the basis of the identified values can exclude left-right asymmetric deformation due to an inter-roll thrust force caused to be generated by the inter-roll cross angle, which makes it possible to stably produce a flat-rolled metal material without zigzagging and camber or with very minor zigzagging and camber.

TABLE 1

| | Camber actual value per 1 m of tip (mm/m) | | |
|---|---|---|---|
| | immediately after backup roll recombination | immediately before backup roll recombination | timing that is immediately before backup roll recombination and immediately before housing liner replacement |
| Present invention | 0.10 | 0.09 | 0.12 |
| Conventional method | 0.15 | 0.45 | 0.70 |

The preferred embodiment(s) of the present invention has/have been described above with reference to the accompanying drawings, whilst the present invention is not limited to the above examples. A person skilled in the art may find various alterations and modifications within the scope of the appended claims, and it should be understood that they will naturally come under the technical scope of the present invention.

For example, the above embodiments describe that an inter-roll cross angle is identified in a state where a predetermined load is applied to the work roll chocks by increase bending devices, but the present invention is not limited to this example. For example, an inter-roll cross angle may be identified in a state where an increase bending force is set constant and a predetermined load is applied between the work roll and the backup roll by decrease bending devices.

In addition, the above embodiments describe that load detection devices in the vertical direction are disposed on both the upper side and the lower side, but the present invention is not limited to this example. An inter-roll cross caused by progress of wear of a chock, a liner of a housing, or the like is predicted to change at substantially the same timing on both the upper side and the lower side. Consequently, even in the case where load detection devices are disposed on one of the upper side and the lower side, an inter-roll cross angle on both the upper side and the lower side can be reduced by identifying an inter-roll cross angle on the side where load detection devices are disposed, and, for example, replacing a shim or the like between the liner on the work roll chock side and the work roll chock on both the upper side and the lower side at the same timing, on the basis of the identification result. Thus, as in the case where load detection devices in the vertical direction are disposed on both the upper side and the lower side, a flat-rolled metal material without zigzagging and camber or with very minor zigzagging and camber can be stably produced.

Figure 12:
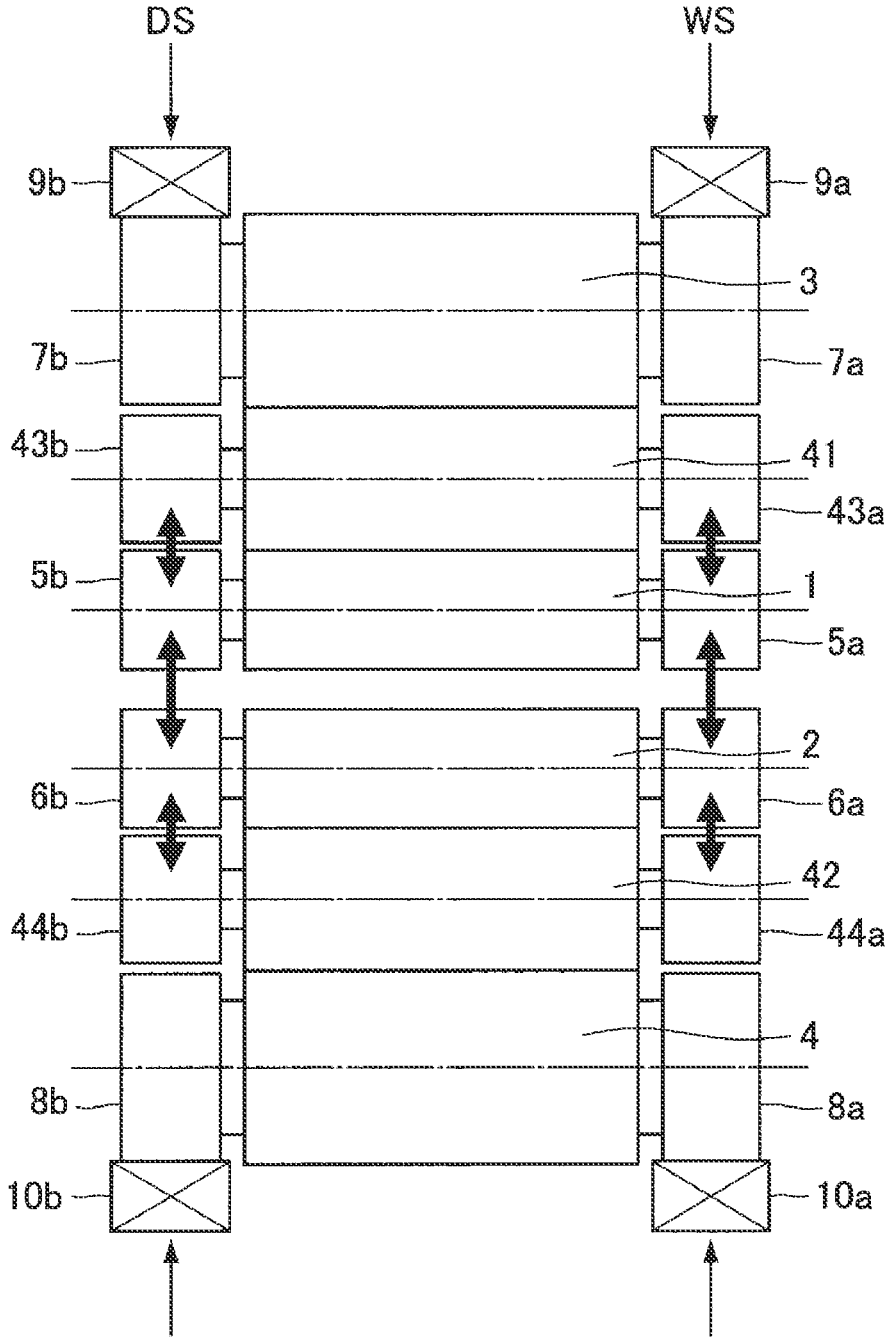
FIG. 12 is a schematic front view illustrating a configuration of a six-high rolling mill.

Furthermore, the above embodiments describe a four-high rolling mill including a pair of work rolls and a pair of backup rolls, but the present invention is not limited to this example, and can be applied to a rolling mill of four-high or more. For example, as illustrated in FIG. 12, the present invention can also be applied to a six-high rolling mill in which intermediate rolls 41 and 42 are provided respectively between the work rolls 1 and 2 and the backup rolls 3 and 4. The upper intermediate roll 41 is supported by an upper intermediate roll chock 43*a* on the working side and an upper intermediate roll chock 43*b* on the driving side. The lower intermediate roll 42 is supported by a lower intermediate roll chock 44 on the working side and a lower intermediate roll chock 44*b* on the driving side.

Figure 13:
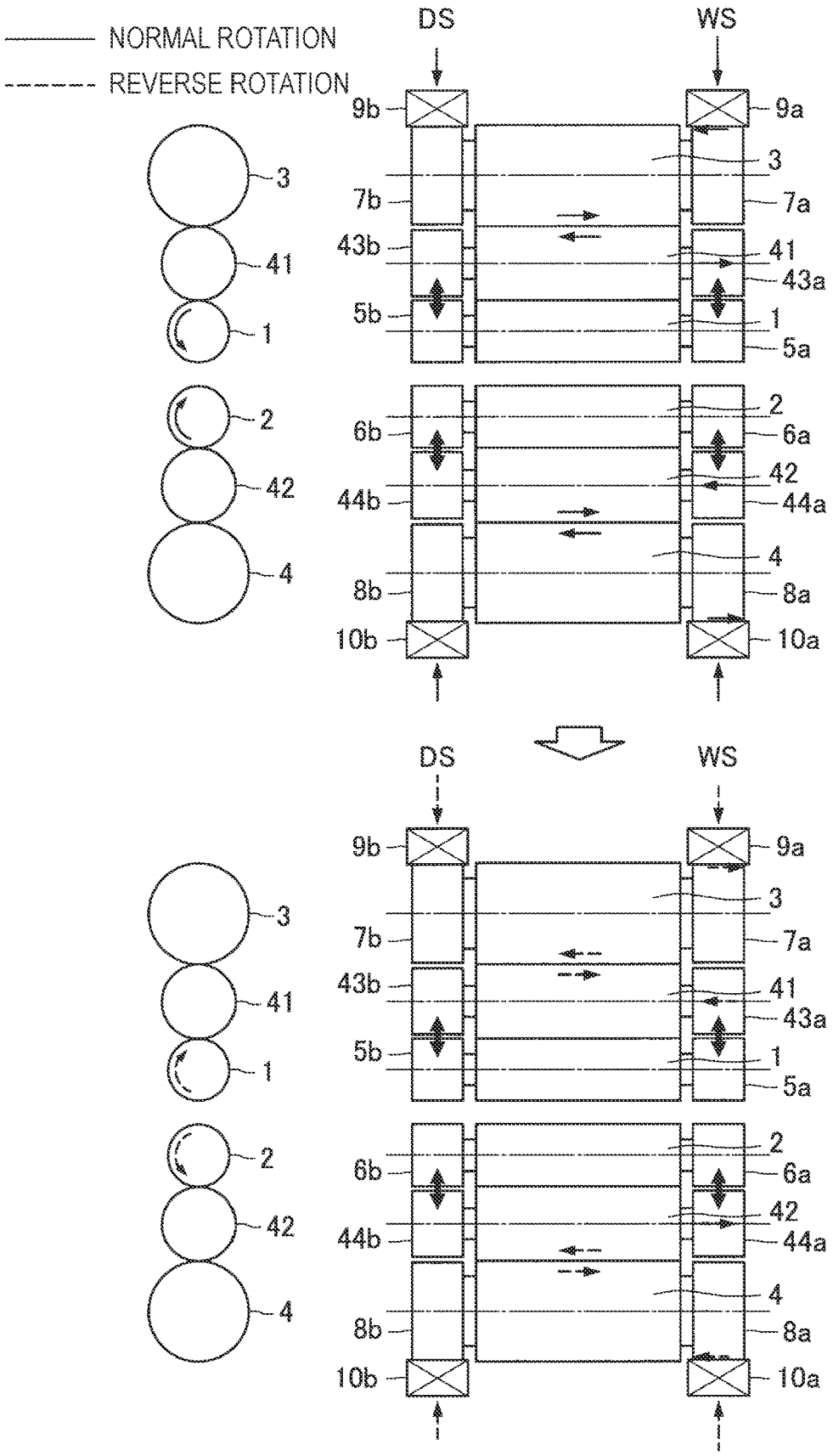
FIG. 13 is a schematic side view and a schematic front view illustrating an example of a driving state of a state of the rolling mill at the time of inter-roll cross angle identification between an intermediate roll and a backup roll, and illustrates a state at the time of identification by normal rotation and reverse rotation of the intermediate rolls accompanying normal rotation and reverse rotation of the work rolls, using bending devices of the intermediate rolls.
Figure 14:
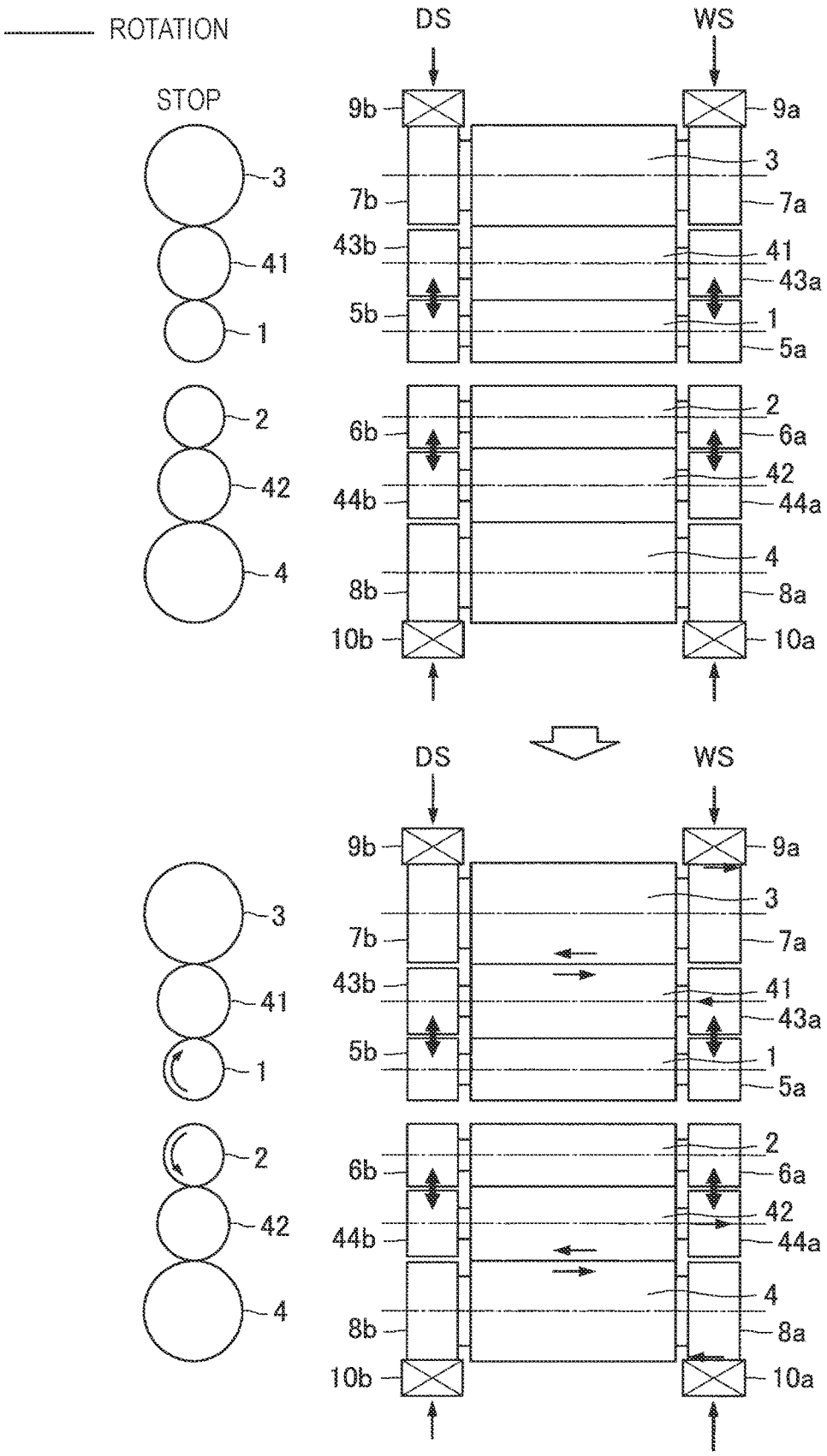
FIG. 14 is a schematic side view and a schematic front view illustrating an example of a driving state of a state of the rolling mill at the time of inter-roll cross angle identification between an intermediate roll and a backup roll, and illustrates a stop state of all rolls and a state at the time of identification by rotation of the intermediate rolls accompanying rotation of the work rolls, using bending devices of the intermediate rolls.

In the case of a six-high rolling mill, for example, as illustrated in FIG. 13 and FIG. 14, with a roll gap between the work roll 1 and the intermediate roll 41 and a roll gap between the work roll 2 and the intermediate roll 42 put into an open state, a load is applied between the intermediate roll 41 and the backup roll 3, and between the intermediate roll 42 and the backup roll 4 by using bending devices of the intermediate rolls 41 and 42. At this time, the bending devices of the work rolls 1 and 2 apply a force enough to cancel a self-weight of the work roll or enough to transfer rotation of the work roll to the intermediate roll (the applied force is not illustrated), for adjustment to a state where a load does not act between the work roll and the intermediate roll. In such a state, an inter-roll cross angle between the intermediate roll 41 and the backup roll 3, and an inter-roll cross angle between the intermediate roll 42 and the backup roll 4 are identified.

In identification of an inter-roll cross angle between the intermediate roll 41 and the backup roll 3, and an inter-roll cross angle between the intermediate roll 42 and the backup roll 4, for example, as illustrated in FIG. 13, vertical roll loads may be detected for each of the case where the work rolls 1 and 2 are normally rotated and the intermediate rolls 41 and 42 are rotated (the upper side of FIG. 13) and the case where the work rolls 1 and 2 are reversely rotated and the intermediate rolls 41 and 42 are rotated (the lower side of FIG. 13), and the inter-roll cross angles may be identified on the basis of the differential load. Alternatively, as illustrated in FIG. 14, vertical roll loads may be detected for each of the case where all rolls are stopped (the upper side of FIG. 14) and the case where the work rolls 1 and 2 are rotated and the intermediate rolls 41 and 42 are rotated (the lower side of FIG. 14), and the inter-roll cross angles may be identified on the basis of the differential load.

In this manner, an inter-roll cross angle between the intermediate roll 41 and the backup roll 3, and an inter-roll cross angle between the intermediate roll 42 and the backup roll 4 are identified, and the intermediate rolls 41 and 42 and the backup rolls 3 and 4 are adjusted. After that, a load is applied between the work roll 1 and the intermediate roll 41, and between the work roll 2 and the intermediate roll 42, by using the bending devices of the work rolls 1 and 2 as in the above embodiments, and an inter-roll cross angle between the work roll and the intermediate roll is identified.

Figure 15:
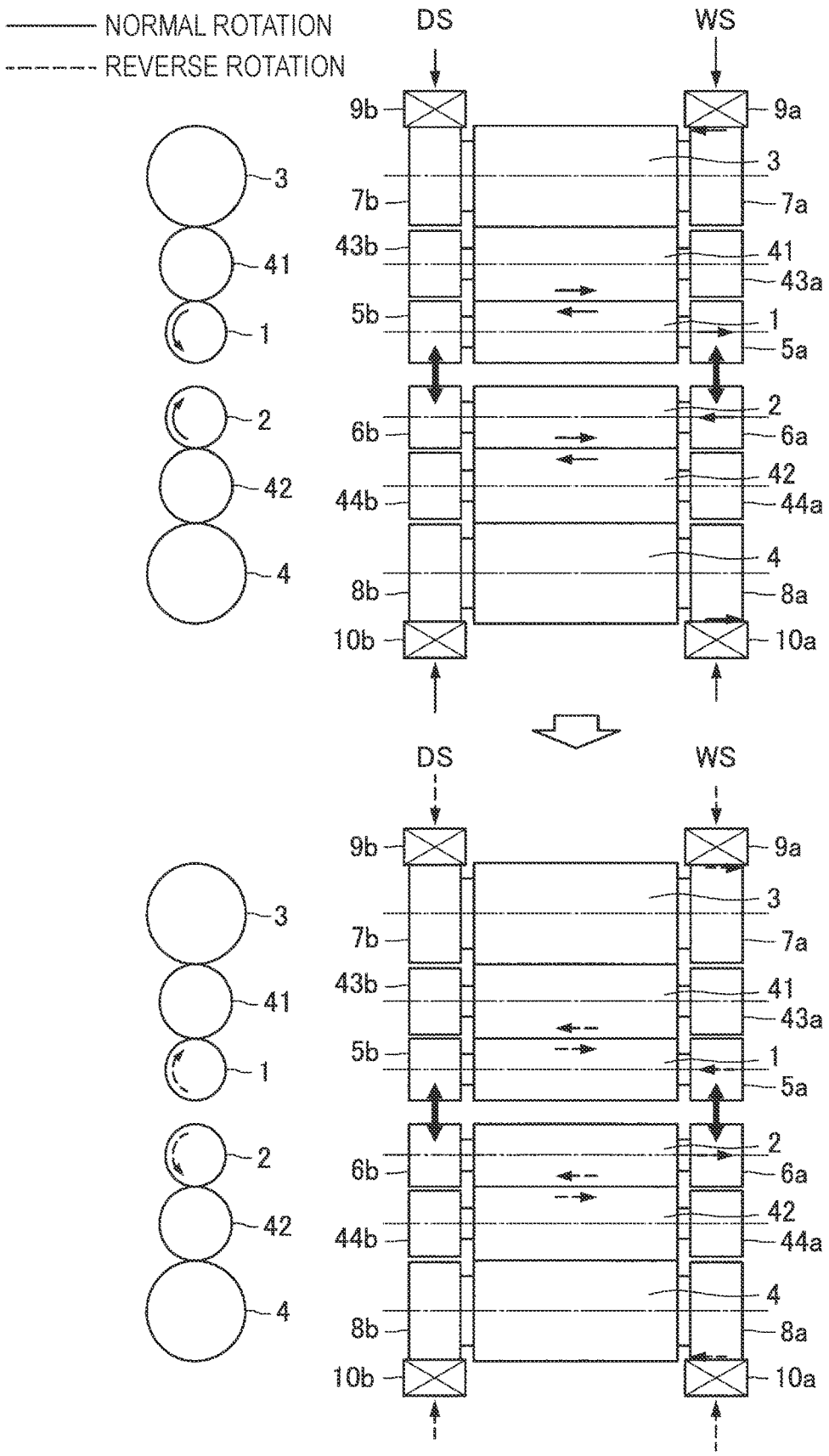
FIG. 15 is a schematic side view and a schematic front view illustrating an example of a driving state of a state of the rolling mill at the time of inter-roll cross angle identification between a work roll and an intermediate roll, and illustrates a state at the time of identification by normal rotation and reverse rotation of the work rolls, using bending devices of the work rolls.
Figure 16:
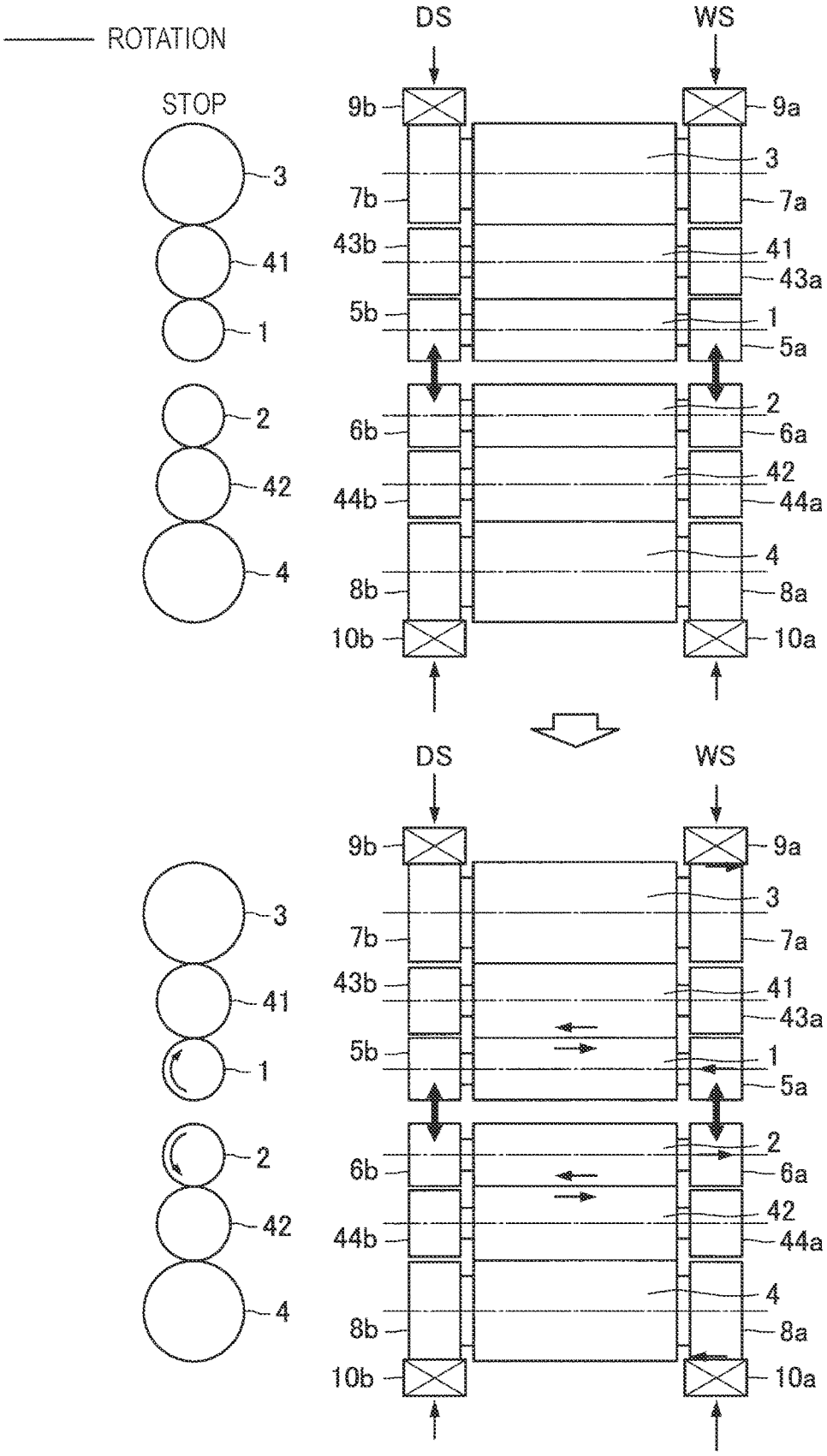
FIG. 16 is a schematic side view and a schematic front view illustrating an example of a driving state of a state of the rolling mill at the time of inter-roll cross angle identification between a work roll and an intermediate roll, and illustrates a state at the time of identification by stop and rotation of the work rolls, using bending devices of the work rolls.

In identification of an inter-roll cross angle between the work roll 1 and the intermediate roll 41, and an inter-roll cross angle between the work roll 2 and the intermediate roll 42, for example, as illustrated in FIG. 15, vertical roll loads may be detected for each of the case where the work rolls 1 and 2 are normally rotated (the upper side of FIG. 15) and the case where the work rolls 1 and 2 are reversely rotated (the lower side of FIG. 15), and the inter-roll cross angles may be identified on the basis of the differential load. Alternatively, as illustrated in FIG. 16, vertical roll loads may be detected for each of the case where all rolls are stopped (the upper side of FIG. 16) and the case where the work rolls 1 and 2 are rotated (the lower side of FIG. 16), and the inter-roll cross angles may be detected on the basis of the differential load. Then, after the inter-roll cross angle between the work roll 1 and the intermediate roll 41, and the inter-roll cross angle between the work roll 2 and the intermediate roll 42 are identified, the work rolls 1 and 2 and the intermediate rolls 41 and 42 may be adjusted. Note that load distribution between rolls also changes with a change in direction of a thrust force between rolls, but description thereof is omitted here because illustration in FIG. 13 to FIG. 16 makes the drawings complicated.

In identifying an inter-roll cross angle between the intermediate roll and the backup roll, and an inter-roll cross angle between the work roll and the intermediate roll, specifically, the formulas related to the work roll and the backup roll described in the above embodiments may be derived assuming each of the intermediate roll and the backup roll, and the work roll and the intermediate roll. By identifying inter-roll cross angles in order in this manner, rolls can be adjusted on the basis of the identified inter-roll cross angles as in the case of a four-high rolling mill, even in the case of a six-high rolling mill. As a result, a flat-rolled metal material without zigzagging and camber or with very minor zigzagging and camber can be stably produced.

REFERENCE SIGNS LIST

1 upper work roll
2 lower work roll
3 upper backup roll
4 lower backup roll
5*a* upper work roll chock (working side)
5*b* upper work roll chock (driving side)
6*a* lower work roll chock (working side)
6*b* lower work roll chock (driving side)
7*a* upper backup roll chock (working side)
7*b* upper backup roll chock (driving side)
8*a* lower backup roll chock (working side)
8*b* lower backup roll chock (driving side)
9*a* upper load detection device (working side)
9*b* upper load detection device (driving side)
10*a* lower load detection device (working side)
10*b* lower load detection device (driving side)
11 housing
13*a* entry side upper increase bending device
13*b* exit side upper increase bending device
14*a* entry side lower increase bending device
14*b* exit side lower increase bending device
15 increase bending control device
16 drive electric motor
17 drive electric motor control device
18 screw down device
19 upper-side differential load calculation unit [subtractor]

20 lower-side differential load calculation unit [subtractor]
21 inter-roll cross angle identification device
23 entry side upper decrease bending device
23*b* exit side upper decrease bending device
24*a* entry side lower decrease bending device
24*b* exit side lower decrease bending device
30*a*, 30*b* rolling support position
41 upper intermediate roll
42 lower intermediate roll
43*a* upper intermediate roll chock (working side)
43*b* upper intermediate roll chock (driving side)
44*a* lower intermediate roll chock (working side)
44*b* lower intermediate roll chock (driving side)

The invention claimed is:

1. A cross angle identification method for identifying an inter-roll cross angle of a rolling mill, the rolling mill being a rolling mill of four-high or more that includes a plurality of rolls including at least a pair of work rolls and a pair of backup rolls, the cross angle identification method comprising:

a roll bending force application step of, when rolling is not performed, applying a roll bending force to apply a load between rolls of an upper roll assembly including the work roll on an upper side and between rolls of a lower roll assembly including the work roll on a lower side, in a state where a roll gap between the work rolls is put into an open state;

a load detection step of detecting vertical roll loads that act in a vertical direction on rolling support positions on a working side and a driving side of at least one of the backup roll on the upper side or the backup roll on the lower side;

a load difference calculation step of calculating a load difference between the vertical roll load on the working side and the vertical roll load on the driving side that are detected; and an identification step of identifying the inter-roll cross angle on the basis of the load difference, wherein the load detection step performs a state of normal rotation and a state of reverse rotation of the work rolls, and detects the vertical roll loads on the working side and the driving side in each rotation state of the work rolls, the load difference calculation step calculates the load difference in each rotation state of the work roll are preformed, and the identification step identifies the inter-roll cross angle on the basis of a relative change of the load difference in each rotation state of the work roll.

2. A cross angle identification method for identifying an inter-roll cross angle of a rolling mill, the rolling mill being a rolling mill of four-high or more that includes a plurality of rolls including at least a pair of work rolls and a pair of backup rolls, the cross angle identification method comprising:

a roll bending force application step of, when rolling is not performed, applying a roll bending force to apply a load between rolls of an upper roll assembly including the work roll on an upper side and between rolls of a lower roll assembly including the work roll on a lower side, in a state where a roll gap between the work rolls is put into an open state;

a load detection step of detecting vertical roll loads that act in a vertical direction on rolling support positions on a working side and a driving side of at least one of the backup roll on the upper side or the backup roll on the lower side;

a load difference calculation step of calculating a load difference between the vertical roll load on the working side and the vertical roll load on the driving side that are detected; and an identification step of identifying the inter-roll cross angle on the basis of the load difference, wherein the load detection step sets at least two levels or more of roll bending forces applied in an open state of the roll gap, performs one of normal rotation and reverse rotation of the work rolls or rotation and stop of the work rolls, and detects the vertical roll loads on the working side and the driving side in each rotation state of the work rolls at each level, and the identification step further identifies an inter-roll frictional coefficient, or a position of a point of a thrust counterforce acting on the backup roll.

3. A cross angle identification method for identifying an inter-roll cross angle of a rolling mill, the rolling mill being a rolling mill of four-high or more that includes a plurality of rolls including at least a pair of work rolls and a pair of backup rolls, the cross angle identification method comprising:

a roll bending force application step of, when rolling is not performed, applying a roll bending force to apply a load between rolls of an upper roll assembly including the work roll on an upper side and between rolls of a lower roll assembly including the work roll on a lower side, in a state where a roll gap between the work rolls is put into an open state;

a load detection step of detecting vertical roll loads that act in a vertical direction on rolling support positions on a working side and a driving side of at least one of the backup roll on the upper side or the backup roll on the lower side;

a load difference calculation step of calculating a load difference between the vertical roll load on the working side and the vertical roll load on the driving side that are detected; and an identification step of identifying the inter-roll cross angle on the basis of the load difference, wherein the load detection step sets at least three levels or more of roll bending forces applied in an open state of the roll gap, performs one of normal rotation and reverse rotation of the work rolls or rotation and stop of the work rolls, and detects the vertical roll loads on the working side and the driving side in each rotation state of the work rolls at each level, and the identification step further identifies an inter-roll frictional coefficient, and a position of a point of a thrust counterforce acting on the backup roll.

* * * * *